US008757689B2

(12) United States Patent
Ding

(10) Patent No.: US 8,757,689 B2
(45) Date of Patent: Jun. 24, 2014

(54) PERMANENT MAGNETIC LIFTING DEVICE

(75) Inventor: Hong Ding, Shanghai (CN)

(73) Assignee: Soph Magnetics (Shanghai) Co., Ltd., Shanghai (CN)

( * ) Notice: Subject to any disclaimer, the term of this patent is extended or adjusted under 35 U.S.C. 154(b) by 25 days.

(21) Appl. No.: 13/521,503

(22) PCT Filed: Feb. 12, 2010

(86) PCT No.: PCT/CN2010/000199

§ 371 (c)(1),
(2), (4) Date: Oct. 2, 2012

(65) Prior Publication Data

US 2013/0026774 A1 Jan. 31, 2013

(51) Int. Cl.
*B66C 1/04* (2006.01)

(52) U.S. Cl.
USPC ..... 294/65.5; 335/288; 335/295

(58) Field of Classification Search
USPC ..... 294/65.5, 907; 335/288, 295; 269/8
See application file for complete search history.

(56) References Cited

U.S. PATENT DOCUMENTS 4,250,478 A * 2/1981 Cardone et al. ..... 335/288
4,465,993 A * 8/1984 Braillon ..... 335/287
5,166,654 A * 11/1992 Doyelle ..... 335/288
5,382,935 A * 1/1995 Doyelle ..... 335/288
5,435,613 A * 7/1995 Jung ..... 294/65.5
6,292,078 B1 * 9/2001 Cardone et al. ..... 335/295
6,331,810 B1 * 12/2001 Jung ..... 335/288
7,548,147 B2 * 6/2009 Chiang ..... 335/285

* cited by examiner

*Primary Examiner* — Dean Kramer

(74) *Attorney, Agent, or Firm* — Kratz, Quintos & Hanson, LLP

(57) ABSTRACT

The present invention provides a kind of permanent magnetic lifting device, which has: a housing, at the bottom of which is a clamping surface for clamping objects; fixed magnet(s), set in housing relatively fixed to housing; a turnable magnet, set in housing relatively turnable to fixed magnet. When turnable magnet is in the first position relative to fixed magnet, the magnetic force generated by fixed magnet and turnable magnet to clamping surface is zero magnetic force; when turnable magnet is in the third position relative to fixed magnet, the magnetic force generated by fixed magnet and turnable magnet to clamping surface is the maximum magnetic force. The permanent magnetic lifting device also has a positioning mechanism for second position to position the turnable magnet in the second position relative to fixed magnet, fixed magnet and turnable magnet generate trial clamping magnetic force to clamping surface for clamping objects on trial.

13 Claims, 15 Drawing Sheets

PERMANENT MAGNETIC LIFTING DEVICE

TECHNICAL FIELD

The present invention relates to a kind of permanent magnetic lifting device, and more specifically, to a kind of permanent magnetic lifting device, which has a housing, a fixed magnet(s), and a turnable magnet, and is able to clamp objects with a clamping surface.

BACKGROUND OF THE TECHNOLOGY

Most of the permanent magnetic lifting devices on the current market have a 3 time safe lifting coefficient under ideal conditions. For example, if a permanent magnetic lifting device has a nominal lifting capacity of 250 kg, its maximum clamping force can be 750 kg under ideal conditions, that is, the maximum clamping force generated under ideal conditions can be 3 times nominal lifting capacity. This is what we call safe lifting coefficient. Because the maximum clamping force that can be generated by a permanent magnetic lifting device relates to many factors, such as the material, dimension, and surface condition of a workpiece, and the size of contact area between a workpiece and a permanent magnetic lifting device, the maximum clamping force that can be generated by a permanent magnetic lifting device may be different under each specific condition. It is possible that a permanent magnetic lifting device with the nominal lifting capacity of 250 kg may generate a maximum lifting force lower than 250 kg under a certain condition. Because an operator has no way to know the maximum clamping force that can be generated by a permanent magnetic lifting device with a certain nominal lifting capacity, even though a workpiece weighs less than nominal lifting capacity, and the workpiece can be lifted up, its safe running is not assured. This is because that the lifting device may be in the critical condition that the workpiece is just workpiece may fall, resulting in a potential risk in safety.

Therefore, if an operator knows whether the ratio of the maximum clamping force that can be generated by a permanent magnetic lifting device under each specific condition to the weight of a workpiece equals or exceeds a certain value, the operator will know whether it is safe to lift the workpiece under this specific condition. What the ratio should be to ensure safety depends on the operation parameters of the lifting mechanism of the permanent magnetic lifting device. This is not covered in the scope for discussion in this patent. However, generally speaking, this ratio can be set to 2, that is, when the ratio of the maximum clamping force that can be generated by a permanent magnetic lifting device to the weight of a workpiece equals or exceeds 2, potential risk in safety can be basically eliminated.

SUMMARY OF THE INVENTION

In view of the above issues, the present invention provides a kind of permanent magnetic lifting device, which enables an operator to easily operate trial clamping, and also to know whether the ratio of the maximum clamping force generated by the permanent magnetic lifting device under the specific condition to the weight of the workpiece equals or exceeds 2 times or 3 times or other specific values, and potential risk in safety can be eliminated through operation of trial clamping.

Technical scheme 1 of the present invention is that the permanent magnetic lifting device has: a housing, at the bottom of which is the clamping surface for clamping objects; a fixed magnet, set in the housing relatively fixed to the housing; a turnable magnet, set in the housing relatively turnable to the fixed magnet. When the turnable magnet is in the first position relative to the fixed magnet, the magnetic force generated by the fixed magnet and the turnable magnet to the clamping surface is zero magnetic force; when the turnable magnet is in the third position relative to the fixed magnet, the magnetic force generated by the fixed magnet and the turnable magnet to the clamping surface is the maximum magnetic force. The permanent magnetic lifting device is characterized by that it has a positioning mechanism for second position. When the positioning mechanism for second position positions said turnable magnet in the second position relative to the fixed magnet, the fixed magnet and the turnable magnet generate trial clamping magnetic force to the clamping surface for trial clamping of objects; the trial clamping magnetic force is higher than said zero magnetic force and lower than said maximum magnetic force.

Technical scheme 2 of the present invention is that said fixed magnet and said turnable magnet are both cuboids; said fixed magnet along its height is perpendicular to the plane on which said clamping surface lies; two sides on the width of said fixed magnet are S pole and N pole respectively; two sides on the width of said turnable magnet are S pole and N pole respectively; said turnable magnet is able to turn around its own centerline parallel to its lengthwise direction; when said turnable magnet turns to said first position, N pole on said turnable magnet and S pole on said fixed magnet are on one side of the width of said fixed magnet, S pole on said turnable magnet and N pole on said fixed magnet are on another side of the width of said fixed magnet; when said turnable magnet turns to said second position, the center plane of said turnable magnet, which bisects the turnable magnet along its height, makes a predetermined included angle with the center plane of said fixed magnet, which bisects the fixed magnet along its height; when said turnable magnet turns to said third position, S pole on said turnable magnet and S pole on said fixed magnet are on one side of the width of said fixed magnet, N pole on said turnable magnet and N pole on said fixed magnet are on another side of the width of said fixed magnet.

Technical scheme 3 of the present invention is that said fixed magnets and said turnable magnet are all cuboids; a pair of said fixed magnets connect to an insulator on both sides of its width and integrate with it, and the planes formed on the insulator lengthwise and widthwise are parallel to the plane on which said clamping surface lies; S poles and N poles on said fixed magnets are on the side opposite the plane on which said clamping surface lies and the side on the back of this side respectively, and a pair of fixed magnets have opposite polarities; two sides on the width of said turnable magnet are S pole and N pole respectively; said turnable magnet is able to turn around its own centerline parallel to its lengthwise direction; when said turnable magnet turns to said first position, one of the pair of said fixed magnets is on the N pole side of said turnable magnet, and the side of that fixed magnet, which is near said turnable magnet, is S pole; another one of the pair of said fixed magnets is on the S pole side of said turnable magnet, and the side of that fixed magnet, which is near said turnable magnet, is N pole; when said turnable magnet turns to said second position, the center plane of said turnable magnet, which bisects the turnable magnet along its height, makes a predetermined included angle with the center plane of the insulator, which bisects the insulator along its height; when said turnable magnet turns to said third position, one of the pair of said fixed magnets is on the S pole side of said turnable magnet, and the side of that fixed magnet, which is near said turnable magnet, is S pole; another one of the pair of said fixed magnets is on the N pole side of said turnable magnet, and the side of that fixed magnet, which is near said turnable magnet, is N pole.

Technical scheme 4 of the present invention is that said fixed magnets and said turnable magnet are all cuboids; a pair of said fixed magnets slant in a splay way symmetrically about the center plane perpendicular to said clamping surface; the sides opposite each other on a pair of said fixed magnets are S pole and N pole respectively, and the sides away from each other are N pole and S pole respectively; two sides on the width of said turnable magnet are S pole and N pole respectively; said turnable magnet is able to turn around its own centerline parallel to its lengthwise direction; when said turnable magnet turns to said first position, one of the two opposite sides of a pair of said fixed magnets is S pole, one side of said turnable magnet opposite that side is N pole, another one of the two opposite sides of a pair of said fixed magnets is N pole, another side of said turnable magnet is S pole; when said turnable magnet turns to said second position, the center plane of said turnable magnet, which bisects the turnable magnet along its height, makes a predetermined included angle with the center plane perpendicular to said clamping surface; when said turnable magnet turns to said third position, one of the two opposite sides of a pair of said fixed magnets is S pole, one side of said turnable magnet opposite that side is S pole, another one of the two opposite sides of a pair of said fixed magnets is N pole, another side of said turnable magnet is N pole.

Technical scheme 5 of the present invention is that the permanent magnetic lifting device also has a handle, this handle is for an operator to operate manually outside said housing to drive said turnable magnet to said first position, said second position or said third position.

Technical scheme 6 of the present invention is that said positioning mechanism for second position includes a first retaining pin, located in the part of said housing, corresponding to the travel route of said handle, in the course of said handle driving said turnable magnet to turn from said first position to said third position; a first spring, applying elastic thrust to the first retaining pin so that the first retaining pin protrudes out of the housing in normal state; and an actuator, exposed outside said housing for an operator to operate so that said first retaining pin overcomes the elastic thrust of said first spring and retracts into said housing.

Technical scheme 7 of the present invention is that there is a slope on the front end of said retaining pin, in the course of said handle driving turnable magnet to turn from said first position to said third position, when said handle moves to the position where said first retaining pin is set, under the condition that said actuator is not operated, said handle touches said slope and pushes that slope so that said first retaining pin overcomes the elastic thrust of said first spring and retracts into said housing, enabling said handle to pass the position where said first retaining pin is set, in the course of said handle driving turnable magnet to turn from said third position to said first position, when said handle moves to the position where said first retaining pin is set, under the condition that said actuator is not operated, said handle touches the plane, which is on the back of said slope, of said first retaining pin and is blocked by that first retaining pin, thus being positioned where said first retaining pin is set.

Technical scheme 8 of the present invention is that the rear end of said first retaining pin touches said first spring, the middle part of said retaining pin integrates with said actuator, said slope is the inclined plane formed by means of cutting the front end of first retaining pin intersecting the axis of said first retaining pin.

Technical scheme 9 of the present invention is that there is no slope on the front end of said first retaining pin, in the course of said handle driving turnable magnet to turn from said first position to said third position, when said handle moves to the position where said first retaining pin is set, under the condition that said actuator is not operated, said handle touches the front end of said first retaining pin, and cannot pass the position where said first retaining pin is set; under the condition that said actuator is operated, said first retaining pin overcomes the elastic thrust of said first spring and retracts into said housing, said handle can pass the position where said first retaining pin is set; in the course of said handle driving turnable magnet to turn from said third position to said first position, when said handle moves to the position where said first retaining pin is set, under the condition that said actuator is not operated, said handle touches the front end of said first retaining pin and is blocked by that first retaining pin, thus being positioned where said first retaining pin is set.

Technical scheme 10 of the present invention is that positioning mechanism for second position includes a second retaining pin; that second retaining pin is set fixedly in the part of said housing, corresponding to the travel route of said handle, in the course of said handle driving said turnable magnet to turn from said first position to said third position, protruding outside said housing; said handle includes: a stopper, which protrudes from the outer circumferential surface of said handle to the side of housing; a pressing piece, which connects said stopper with a rod-like part and protrudes out of said handle for a certain distance for an operator to depress to move the stopper; a second spring, which applies elastic thrust to that pressing piece so that that pressing piece keeps protruding out of said handle for a certain distance in normal state.

Technical scheme 11 of the present invention is that in the course of said handle driving said turnable magnet to turn from said first position to said third position or turn from said third position to said first position, when said handle moves to the position where said second retaining pin is set, under the condition that said pressing piece is not depressed, said stopper on said handle touches said second retaining pin so that said handle is blocked by said second retaining pin; under the condition that said pressing piece is depressed by an operator, said stopper moves to avoid touching said second retaining pin, enabling said handle to pass the position where said second retaining pin is set.

Technical scheme 12 of the present invention is that said trial clamping magnetic force is within 10% to 90% of said maximum magnetic force.

Technical scheme 13 of the present invention is that said trial clamping magnetic force is 50% of said maximum magnetic force.

In the technical schemes of the present invention, positioning turnable magnet in the second position by means of the positioning mechanism for second position, so that trial clamping magnetic force is higher than zero magnetic force and lower than maximum magnetic force, enables an operator to easily operate trial clamping, and also to know whether the ratio of the maximum clamping force that can be generated by the permanent magnetic lifting device under the specific condition to the weight of the workpiece equals or exceeds 2 times or 3 times or other specific values, and potential risk in safety can be eliminated through operation of trial clamping.

EMBODIMENTS

Figure 1:
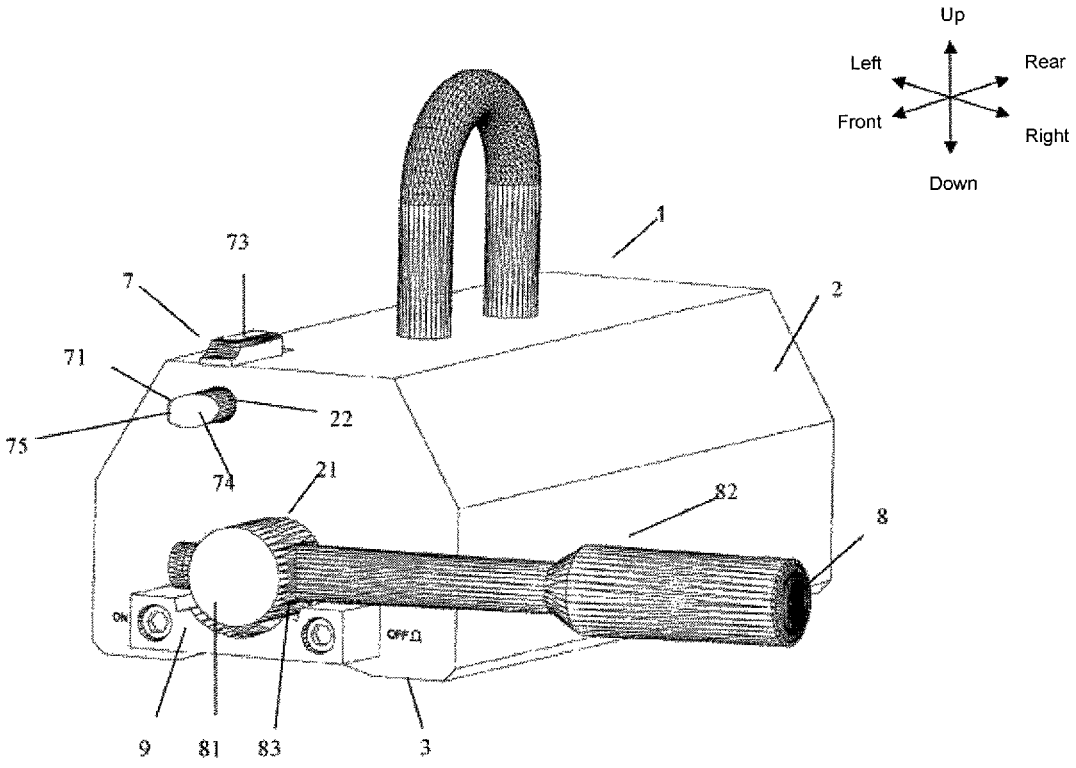
FIG. 1 is a three-dimensional appearance view of the permanent magnetic lifting device of the first embodiment in accordance with the present invention when the turnable magnet of the permanent magnetic lifting device is in the first position.
Figure 2:
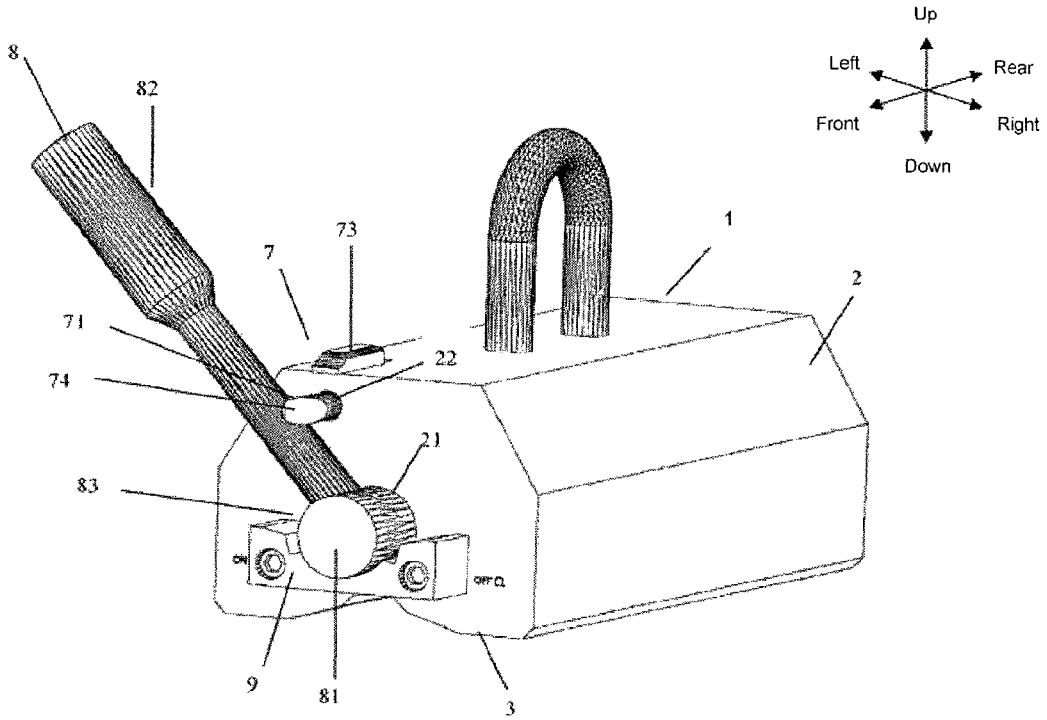
FIG. 2 is a three-dimensional appearance view of the permanent magnetic lifting device of the same embodiment as above when the turnable magnet of the permanent magnetic lifting device is in the second position.
Figure 3:
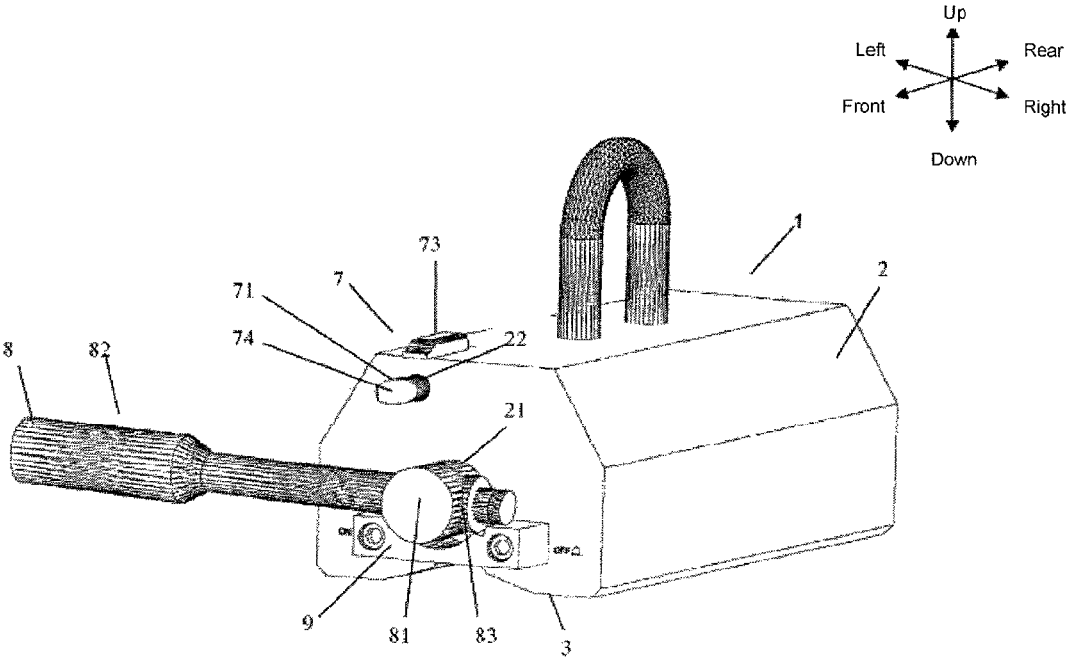
FIG. 3 is a three-dimensional appearance view of the permanent magnetic lifting device of the same embodiment as above when the turnable magnet of the permanent magnetic lifting device is in the third position.
Figure 4:
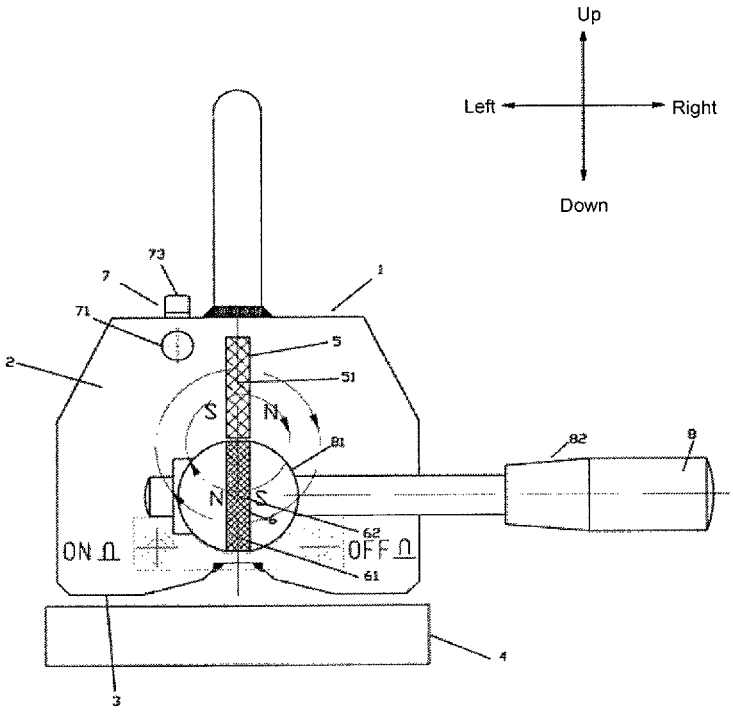
FIG. 4 is a schematic diagram of the lines of magnetic force inside the permanent magnetic lifting device of the same embodiment as above and the workpiece when the permanent magnetic lifting device is in the first position.
Figure 5:
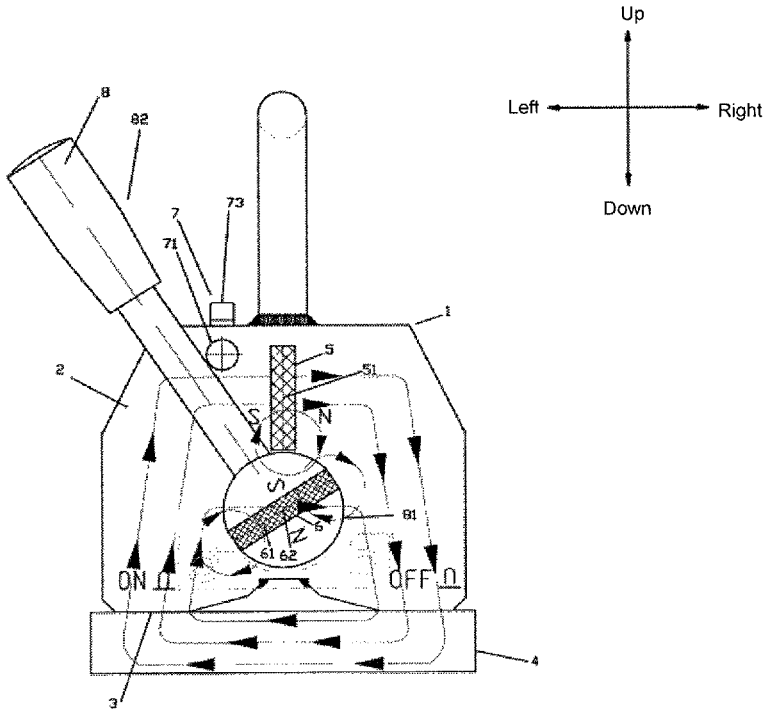
FIG. 5 is a schematic diagram of the lines of magnetic force inside the permanent magnetic lifting device of the same embodiment as above and the workpiece when the permanent magnetic lifting device is in the second position.
Figure 6:
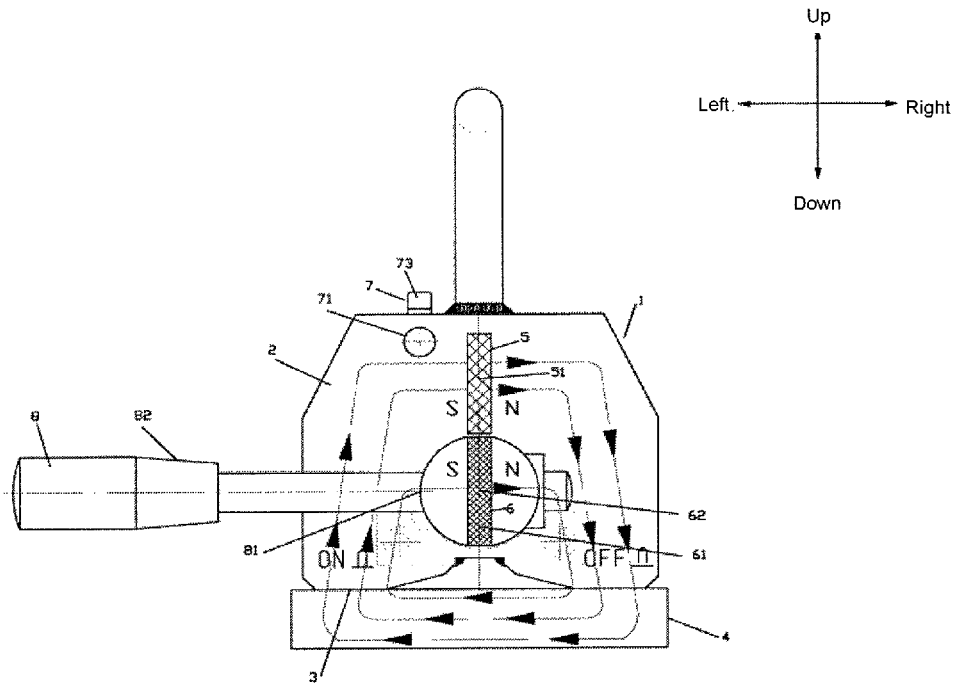
FIG. 6 is a schematic diagram of the lines of magnetic force inside the permanent magnetic lifting device of the same embodiment as above and the workpiece when the permanent magnetic lifting device is in the third position.
Figure 7:
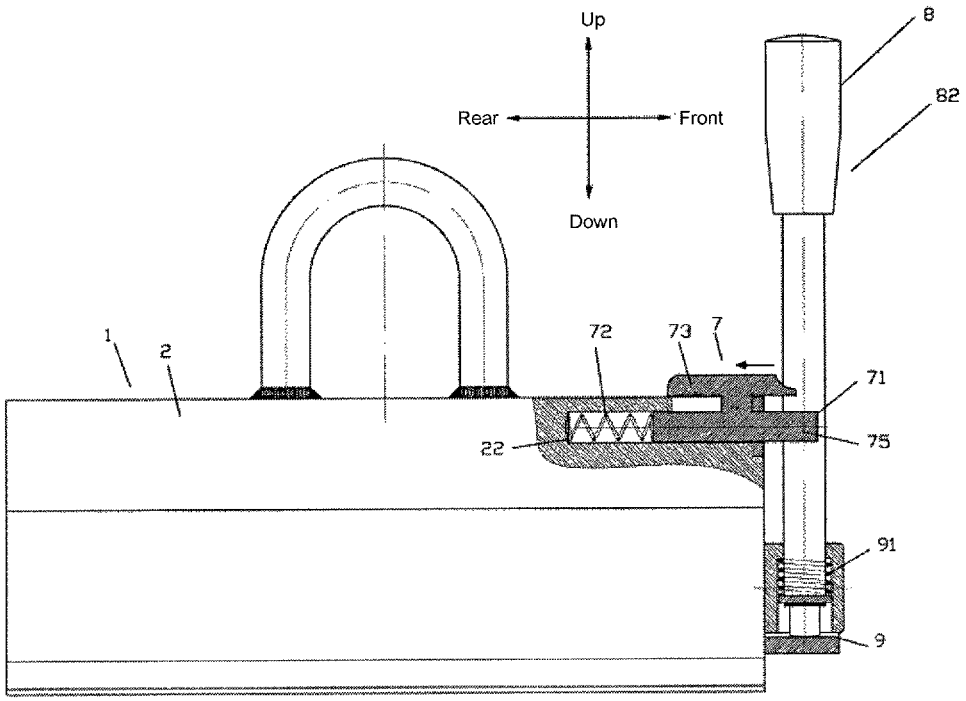
FIG. 7 is a longitudinal partial sectional view of the permanent magnetic lifting device of the same embodiment as above.
Figure 8:
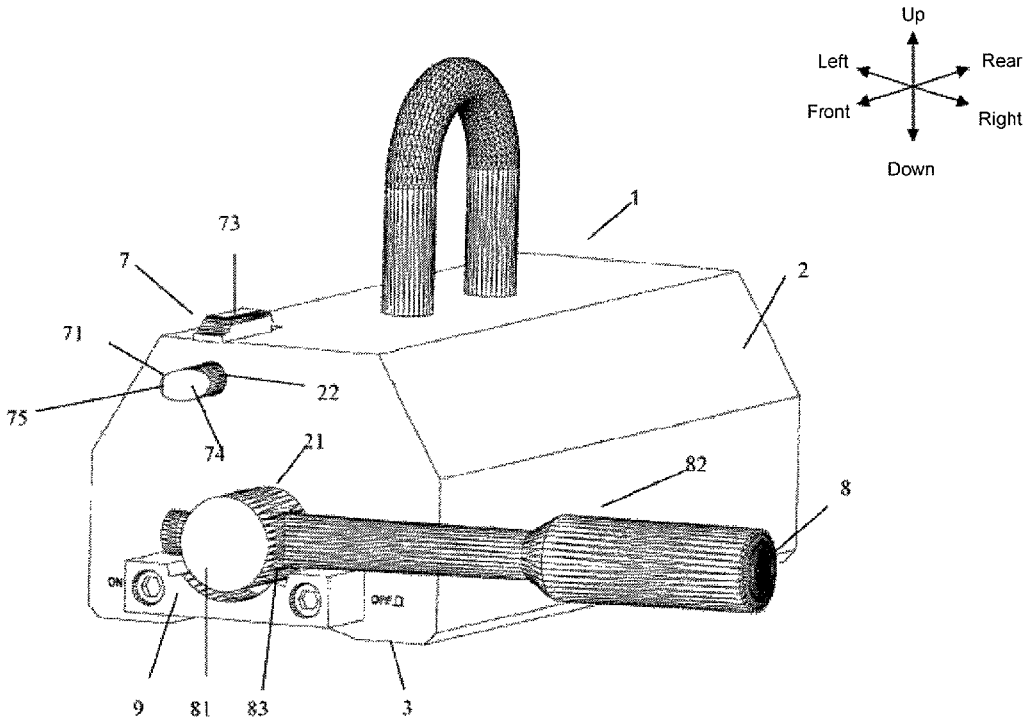
FIG. 8 is a three-dimensional appearance view of the permanent magnetic lifting device of the second embodiment in accordance with the present invention.
Figure 9:
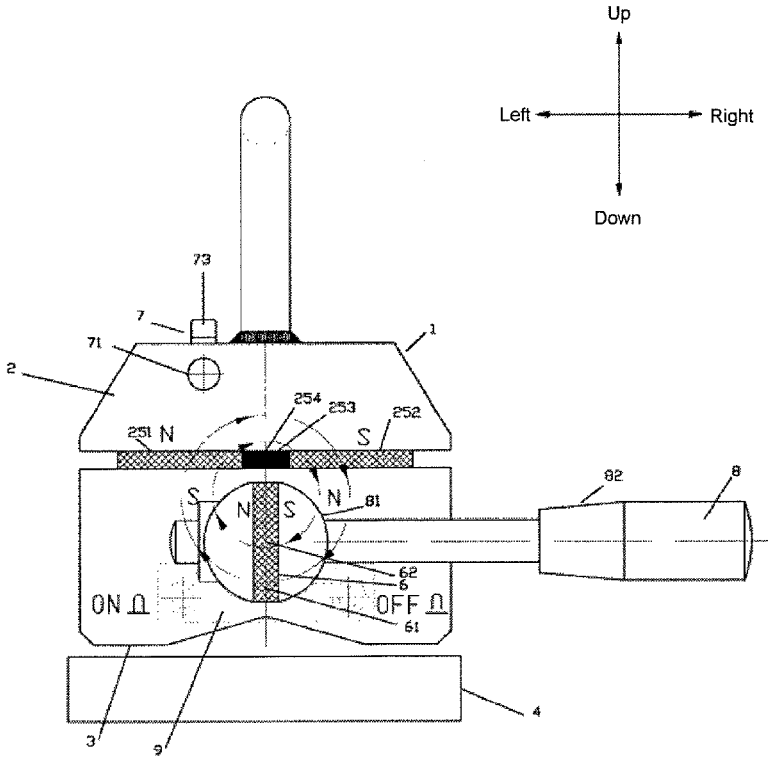
FIG. 9 is a schematic diagram of the lines of magnetic force inside the permanent magnetic lifting device of the same embodiment as above and the workpiece when the permanent magnetic lifting device is in the first position.
Figure 10:
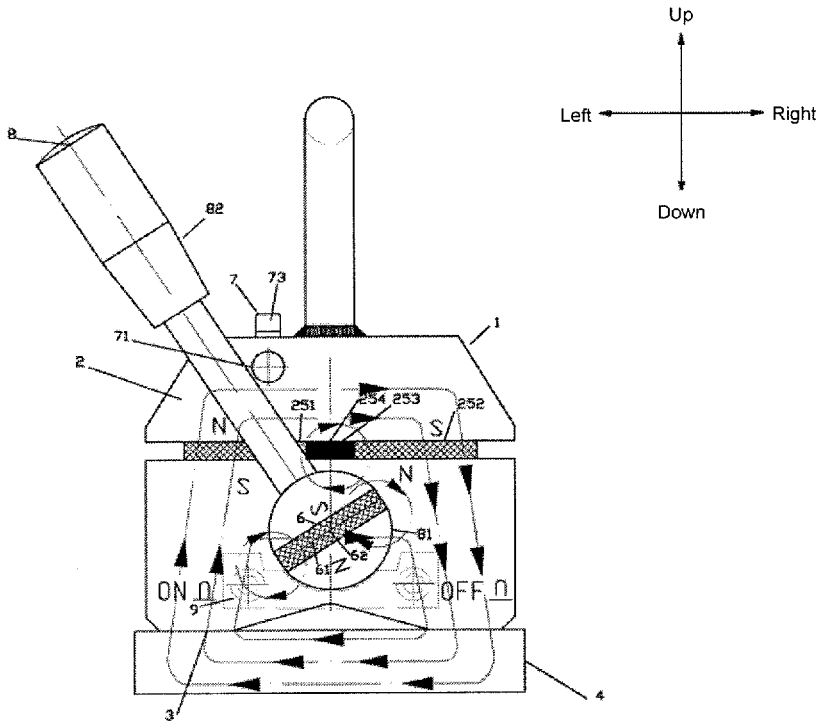
FIG. 10 is a schematic diagram of the lines of magnetic force inside the permanent magnetic lifting device of the same embodiment as above and the workpiece when the permanent magnetic lifting device is in the second position.
Figure 11:
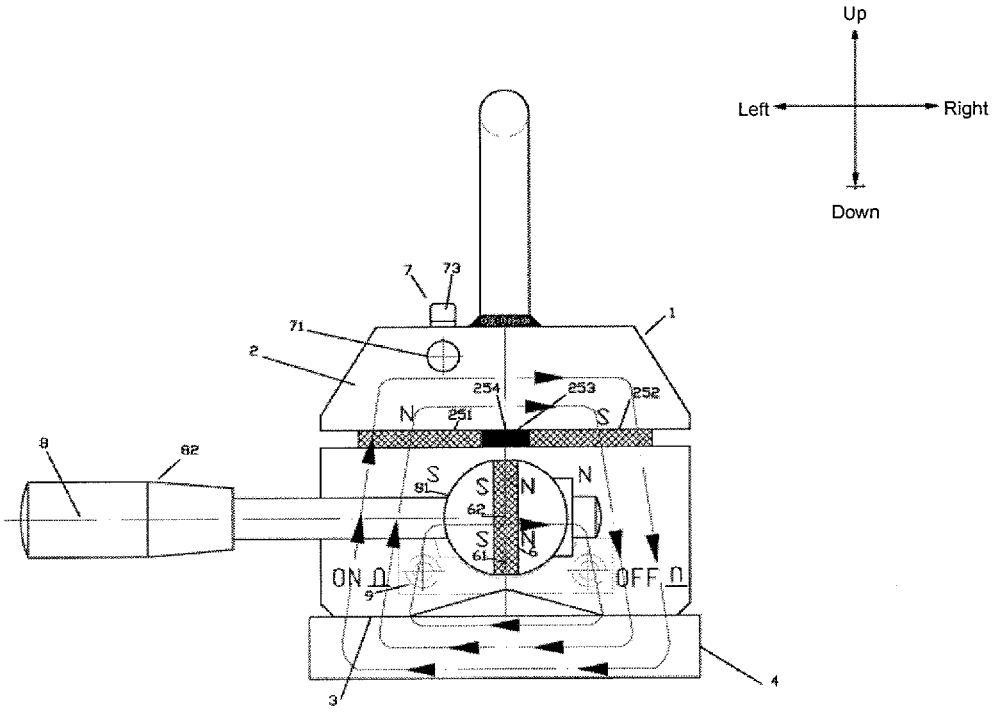
FIG. 11 is a schematic diagram of the lines of magnetic force inside the permanent magnetic lifting device of the same embodiment as above and the workpiece when the permanent magnetic lifting device is in the third position.
Figure 12:
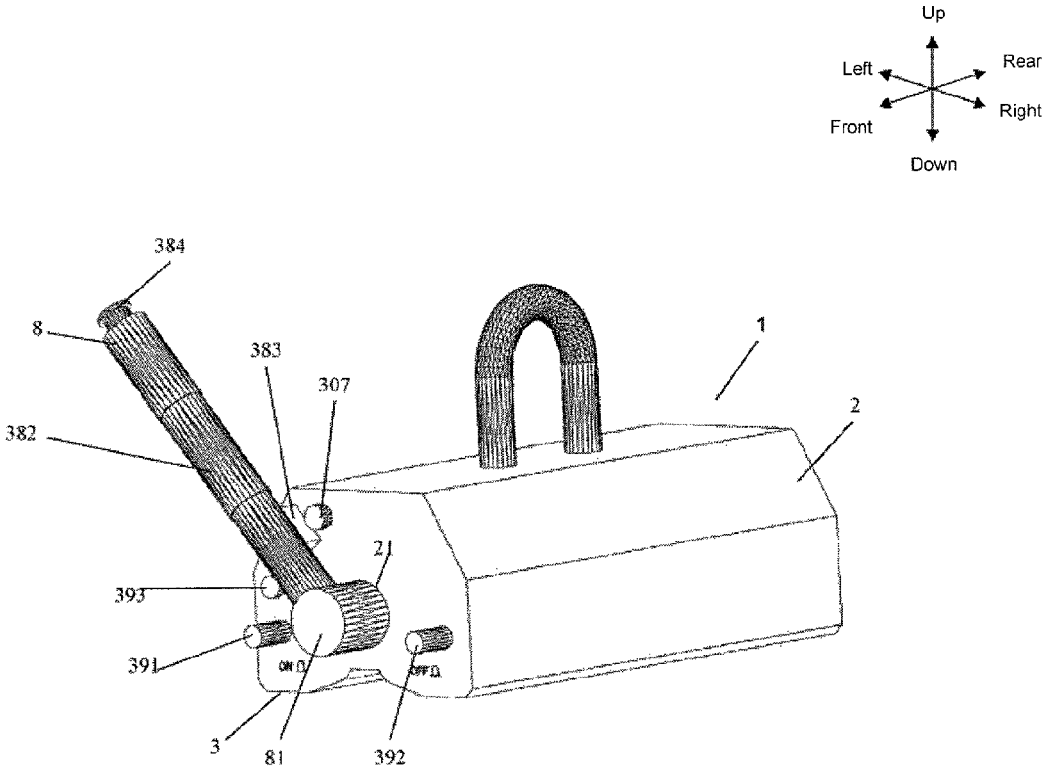
FIG. 12 is a three-dimensional appearance view of the permanent magnetic lifting device of the third embodiment in accordance with the present invention.
Figure 13:
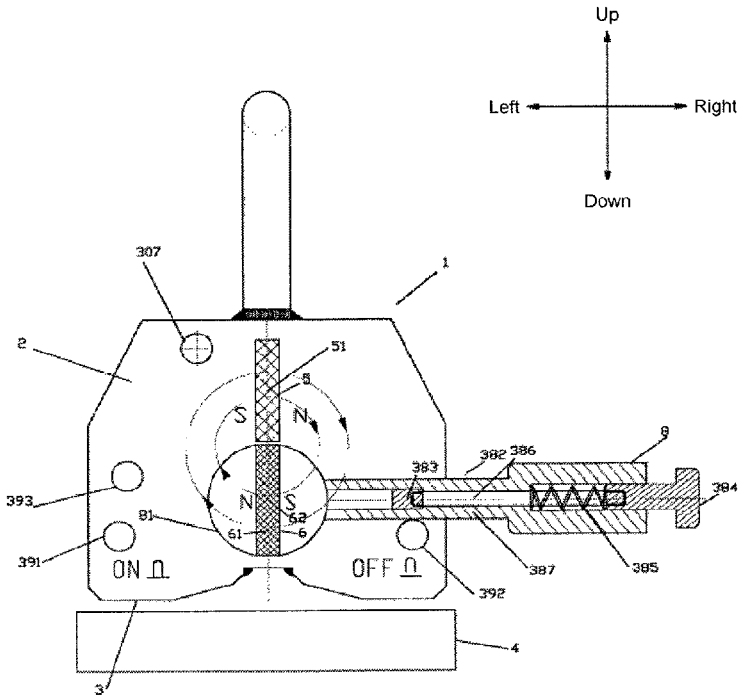
FIG. 13 is a schematic diagram of the lines of magnetic force inside the permanent magnetic lifting device of the same embodiment as above and the workpiece when the permanent magnetic lifting device is in the first position.
Figure 14:
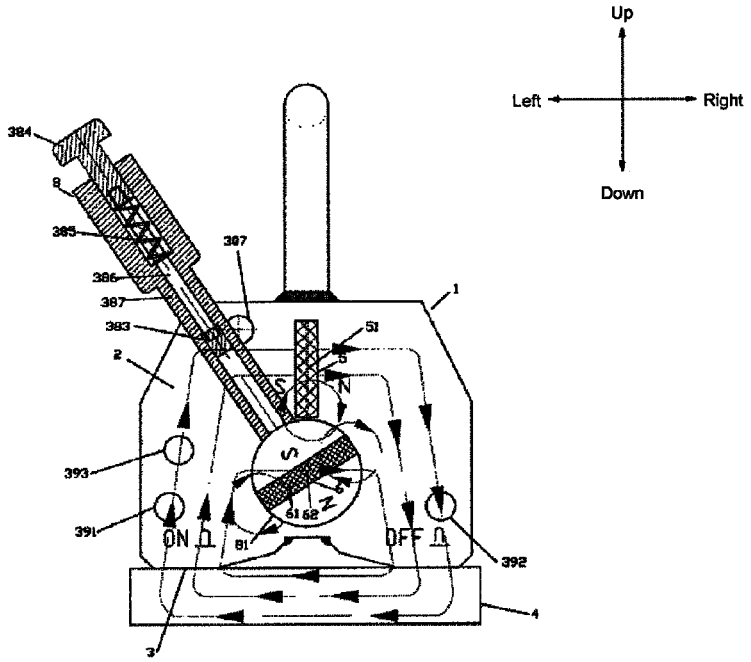
FIG. 14 is a schematic diagram of the lines of magnetic force inside the permanent magnetic lifting device of the same embodiment as above and the workpiece when the permanent magnetic lifting device is in the second position.
Figure 15:
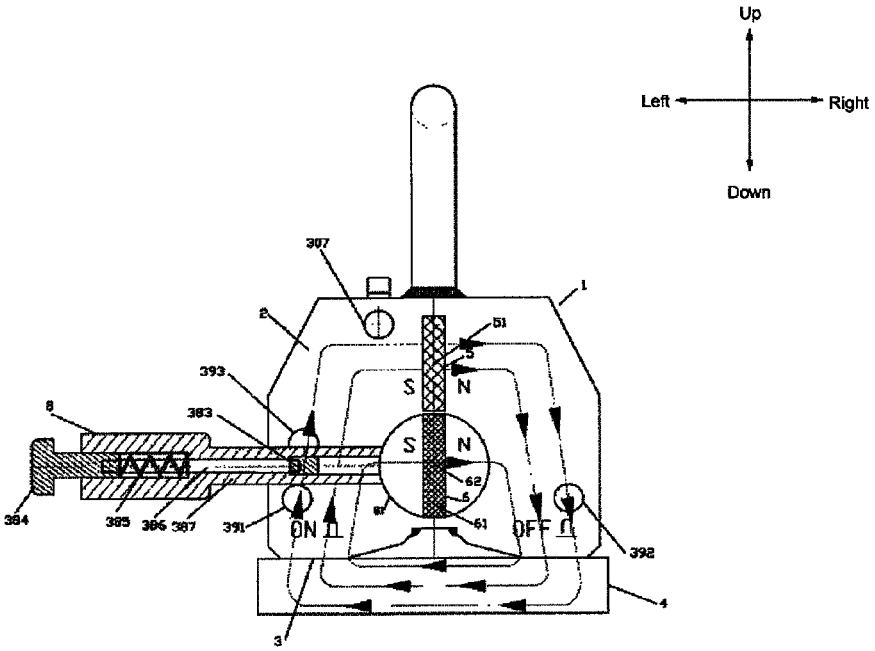
FIG. 15 is a schematic diagram of the lines of magnetic force inside the permanent magnetic lifting device of the same embodiment as above and the workpiece when the permanent magnetic lifting device is in the third position.
Figure 16:
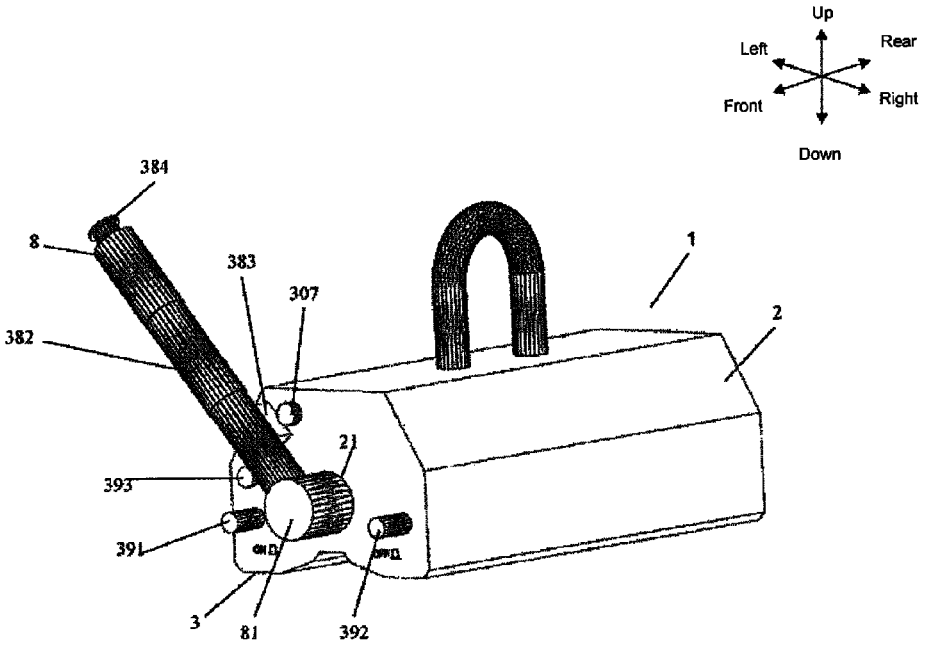
FIG. 16 is a three-dimensional appearance view of the permanent magnetic lifting device of the fourth embodiment in accordance with the present invention.
Figure 17:
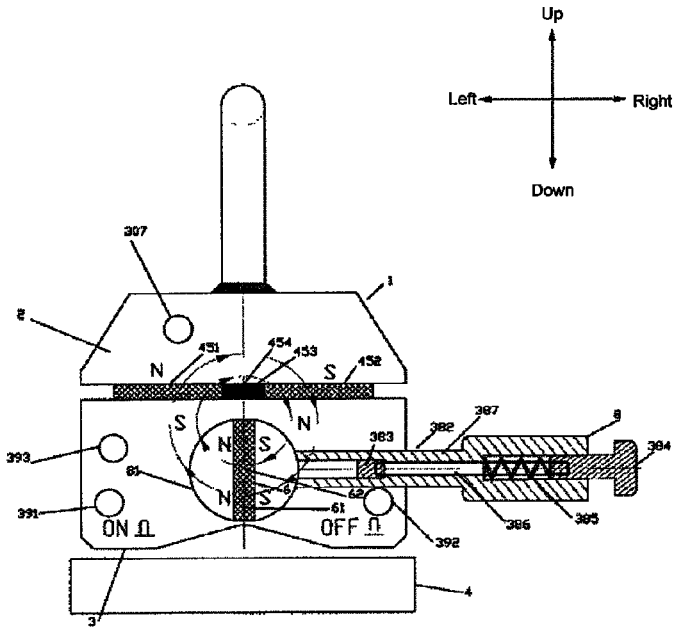
FIG. 17 is a schematic diagram of the lines of magnetic force inside the permanent magnetic lifting device of the same embodiment as above and the workpiece when the permanent magnetic lifting device is in the first position.
Figure 18:
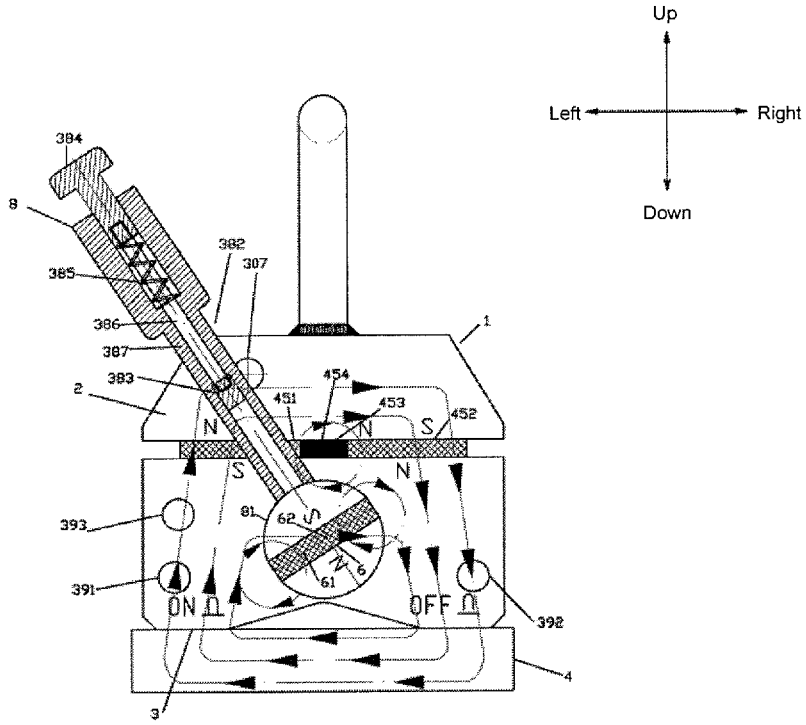
FIG. 18 is a schematic diagram of the lines of magnetic force inside the permanent magnetic lifting device of the same embodiment as above and the workpiece when the permanent magnetic lifting device is in the second position.
Figure 19:
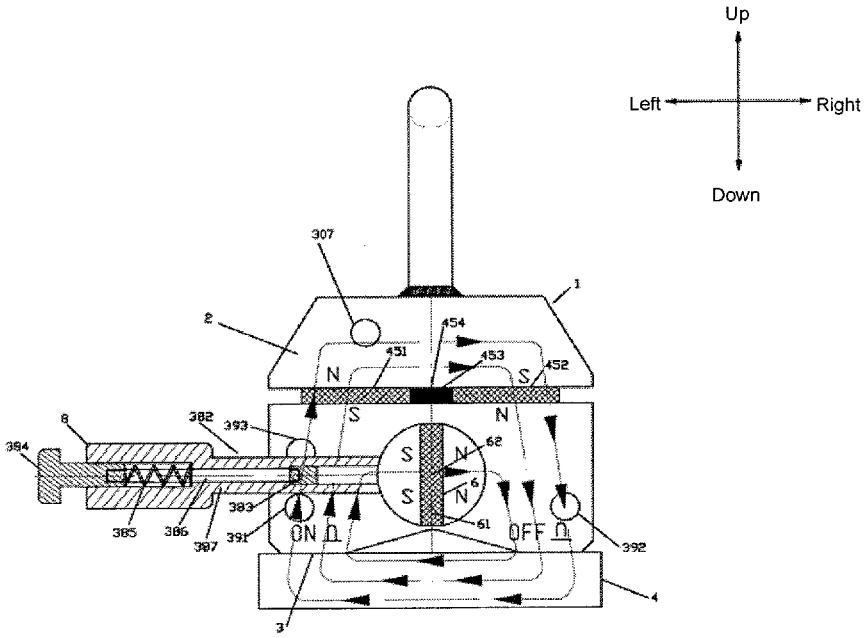
FIG. 19 is a schematic diagram of the lines of magnetic force inside the permanent magnetic lifting device of the same embodiment as above and the workpiece when the permanent magnetic lifting device is in the third position.
Figure 20:
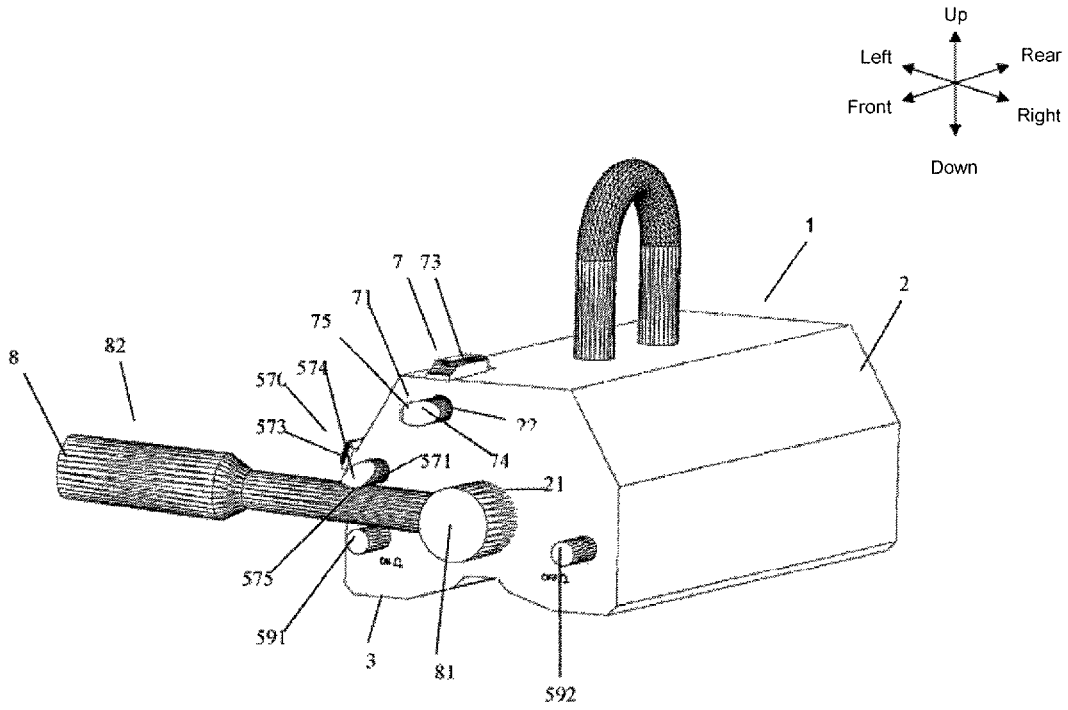
FIG. 20 is a three-dimensional appearance view of the permanent magnetic lifting device of the fifth embodiment in accordance with the present invention.
Figure 21:
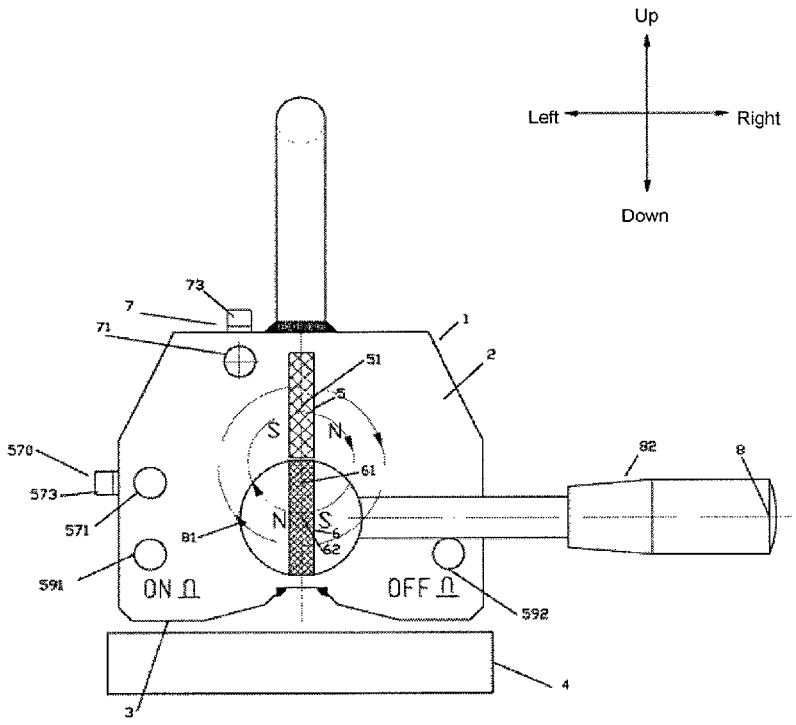
FIG. 21 is a schematic diagram of the lines of magnetic force inside the permanent magnetic lifting device of the same embodiment as above and the workpiece when the permanent magnetic lifting device is in the first position.
Figure 22:
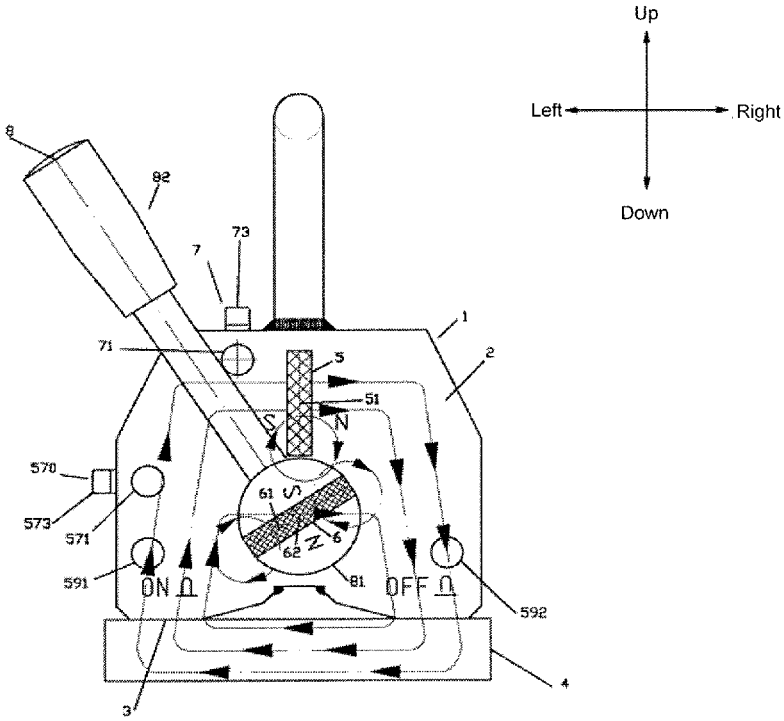
FIG. 22 is a schematic diagram of the lines of magnetic force inside the permanent magnetic lifting device of the same embodiment as above and the workpiece when the permanent magnetic lifting device is in the second position.
Figure 23:
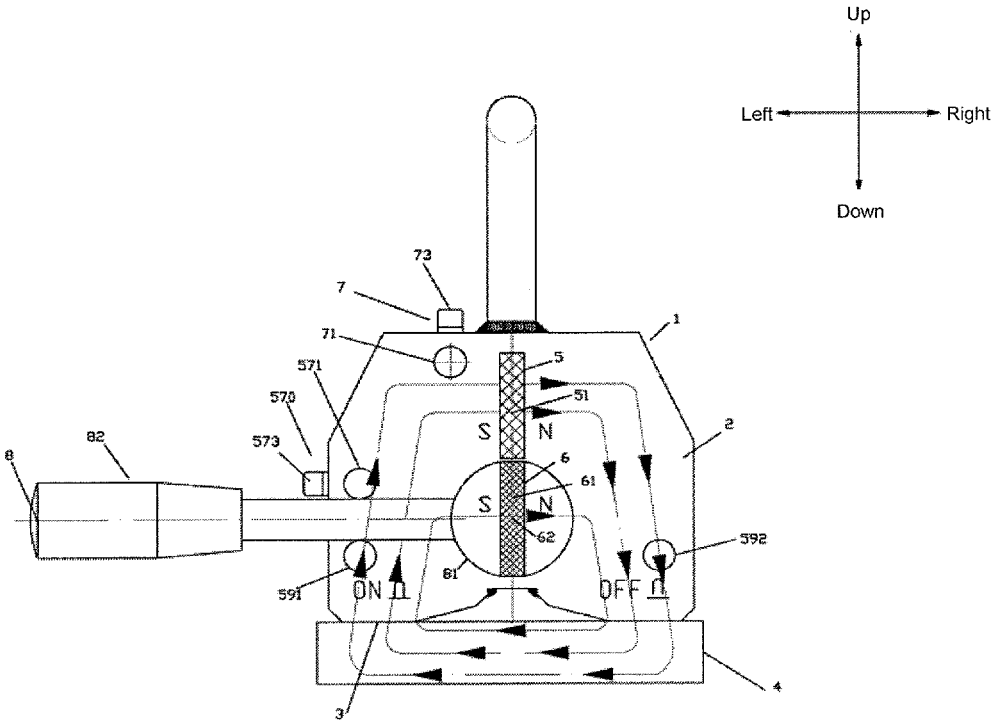
FIG. 23 is a schematic diagram of the lines of magnetic force inside the permanent magnetic lifting device of the same embodiment as above and the workpiece when the permanent magnetic lifting device is in the third position.
Figure 24:
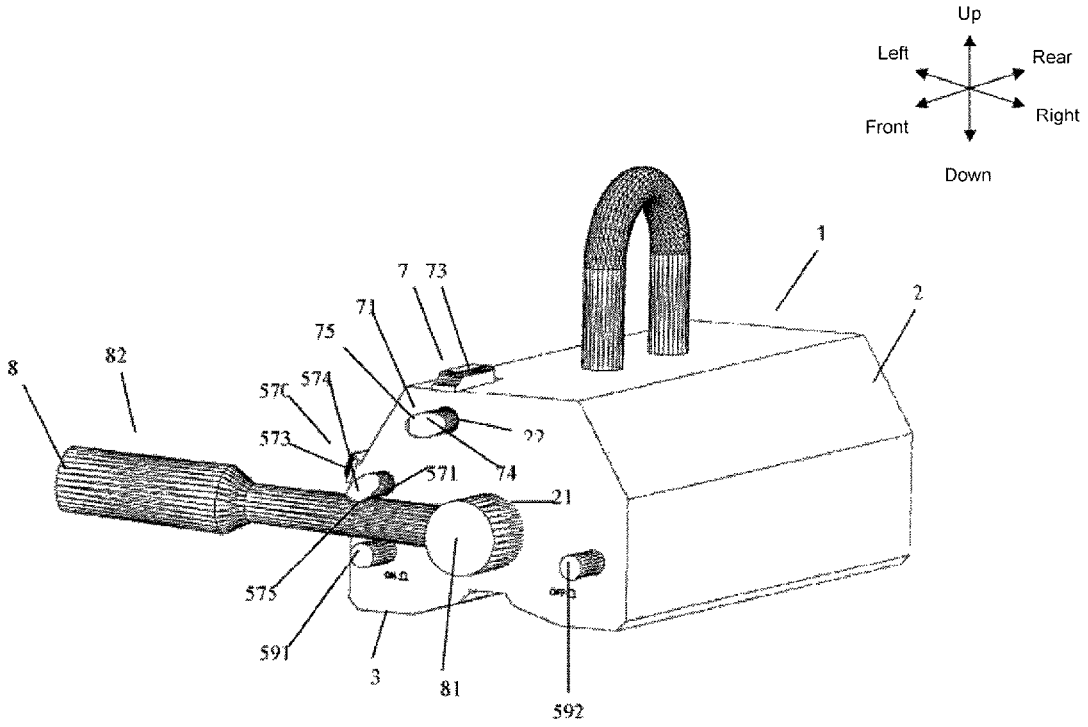
FIG. 24 is a three-dimensional appearance view of the permanent magnetic lifting device of the sixth embodiment in accordance with the present invention.
Figure 25:
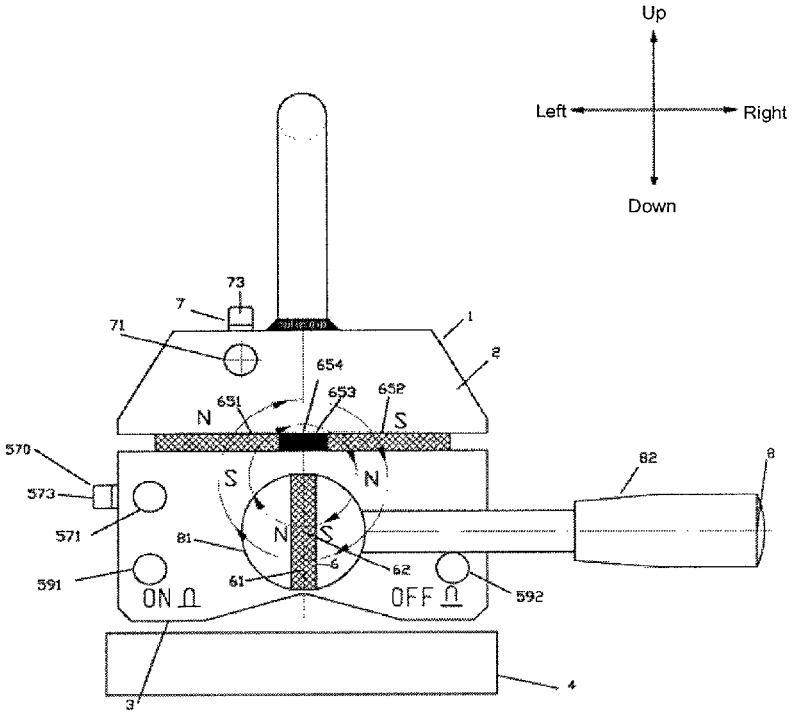
FIG. 25 is a schematic diagram of the lines of magnetic force inside the permanent magnetic lifting device of the same embodiment as above and the workpiece when the permanent magnetic lifting device is in the first position.
Figure 26:
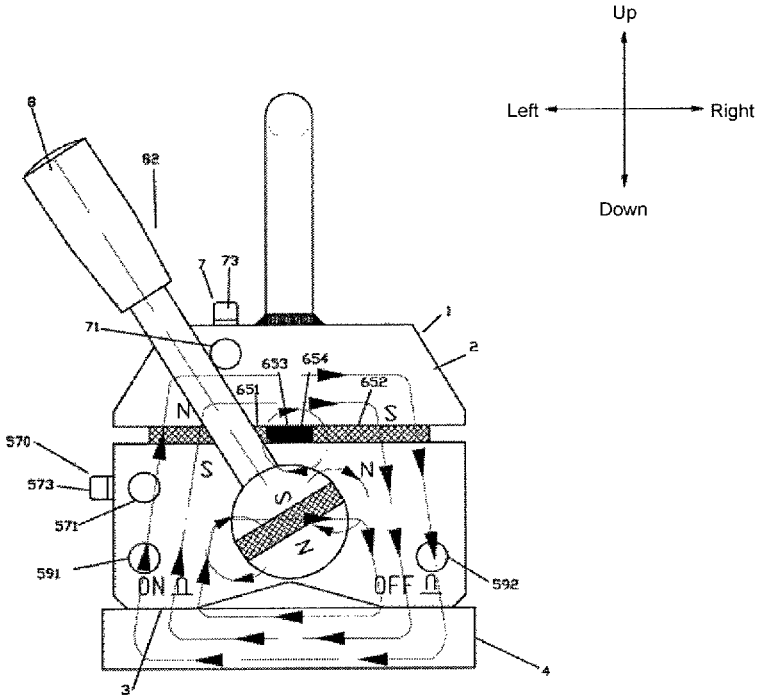
FIG. 26 is a schematic diagram of the lines of magnetic force inside the permanent magnetic lifting device of the same embodiment as above and the workpiece when the permanent magnetic lifting device is in the second position.
Figure 27:
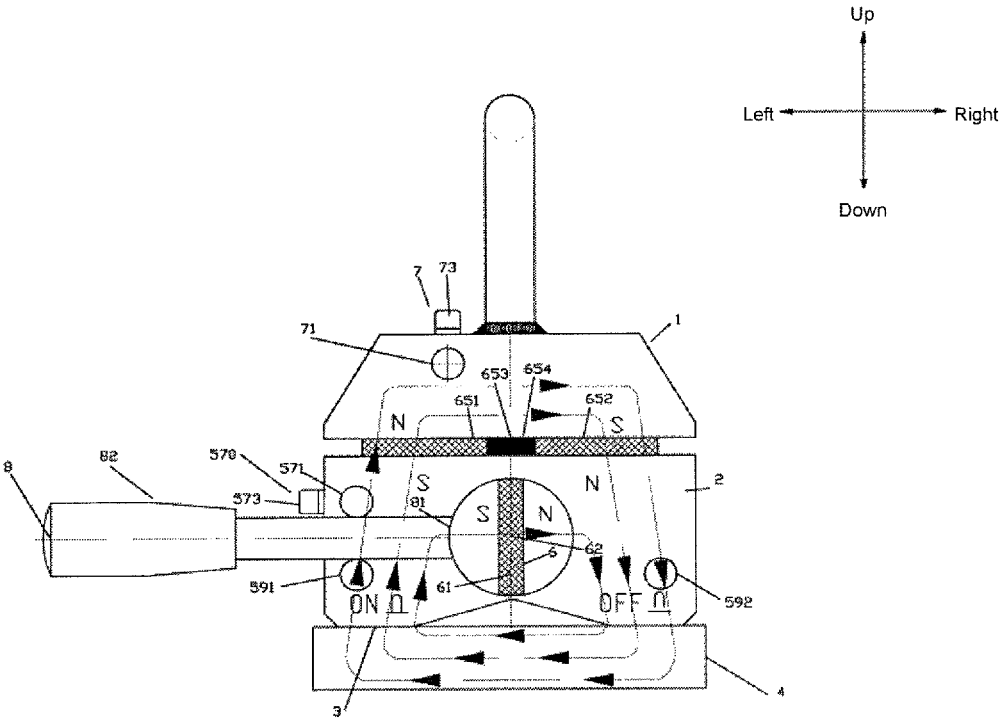
FIG. 27 is a schematic diagram of the lines of magnetic force inside the permanent magnetic lifting device of the same embodiment as above and the workpiece when the permanent magnetic lifting device is in the third position.

The first embodiment in accordance with the present invention is described in detail with reference to FIGS. 1 to 7.

Permanent magnetic lifting device 1, which has: a housing 2, at the bottom of which is a clamping surface 3 for clamping object 4; a fixed magnet 5, set in housing 2 relatively fixed to housing 2; a turnable magnet 6, set in housing 2 relatively turnable to fixed magnet 5. When turnable magnet 6 is in the first position relative to fixed magnet 5, the magnetic force generated by fixed magnet 5 and turnable magnet 6 to clamping surface 3 is zero magnetic force; when turnable magnet 6 is in the third position relative to fixed magnet 5, the magnetic force generated by fixed magnet 5 and turnable magnet 6 to clamping surface 3 is the maximum magnetic force. The permanent magnetic lifting device 1 also has a positioning mechanism 7 for second position. The positioning mechanism 7 for second position positions turnable magnet 6 in the second position relative to fixed magnet 5, fixed magnet 5 and turnable magnet 6 generate trial clamping magnetic force to clamping surface 3 for trial clamping of object 4; the trial clamping magnetic force is higher than said zero magnetic force and lower than the maximum magnetic force. It is better to have said trial clamping magnetic force within 10% to 90% of maximum magnetic force. It is the best to have said trial clamping magnetic force be 50% of maximum magnetic force, that is, if a workpiece can be lifted up with the trial clamping magnetic force in second position, it can be determined that under the specific condition, the ratio of the maximum clamping force that can be generated by the permanent magnetic lifting device in third position to the weight of workpiece is certain to equal or exceed the ratio set for second position, which is 1/50%, namely 2 times.

Similarly, if the trial clamping magnetic force set for second position is 30% of the maximum magnetic force, then the ratio set for second position is 1/30%, namely 3.33 times.

Specifically, clamping surface 3 is two bilaterally symmetrical parts of the lower surface of housing 2, in a planar form.

Fixed magnet 5 and turnable magnet 6 are both cuboids. Fixed magnet 5 is fixed to the upper part inside housing 2, and is located in the center in left-right direction of permanent magnetic lifting device 1. The fixed magnet 5 is so fixed that it is along its height perpendicular to the plane on which clamping surface 3 lies, the direction of its height agrees with the up-down direction, the direction of its width agrees with the left-right direction, and the direction of its length agrees with the front-rear direction. Two sides on the width of fixed magnet 5 are S pole and N pole respectively. Two sides on the width of turnable magnet 6 are S pole and N pole respectively. Turnable magnet 6 is set in the lower part inside housing 2, and is located in the center in left-right to direction of permanent magnetic lifting device 1. The turnable magnet 6 is so set that the direction of its length agrees with the front-rear direction, and it is able to turn around its own centerline 62 parallel to its lengthwise direction; the centerline 62 is approximately on the plane on which lies center plane 51 which bisects fixed magnet 5 along the height of fixed magnet 5.

When turnable magnet 6 turns to the first position, center plane 61 of turnable magnet 6, which bisects turnable magnet 6 along the height of turnable magnet 6, roughly aligns to center plane 51 of fixed magnet 5 (if the magnetic energy of turnable magnet 6 is greater than the magnetic energy of fixed magnet 5, a relatively small angle can be included between center plane 61 of turnable magnet 6 and center plane 51 of fixed magnet 5, at this time, the magnetic energy of turnable magnet 6, after partial short-circuit, the remaining magnetic energy is neutralized with the magnetic energy of fixed magnet 5), and is roughly on the same plane; turnable magnet 6 is so set that the direction of its width agrees with the left-right direction, and the direction of its height agrees with the up-down direction; and N pole on turnable magnet 6 and S pole on fixed magnet 5 are both on the left side of fixed magnet 5, S pole on turnable magnet 6 and N pole on fixed magnet 5 are both on the right side of fixed magnet 5. Of course, polarities on turnable magnet 6 and fixed magnet 5 can be the opposite of above description. At this time, the direction of magnetic field generated by fixed magnet 5 is exactly opposite the direction of magnetic field generated by turnable magnet 6, as shown with the lines of magnetic force in FIG. 4. Two magnetic fields are neutralized, the magnetic force generated to clamping surface 3 is zero, and object 4 cannot be clamped.

When turnable magnet 6 turns to the second position, center plane 61 of turnable magnet 6 makes a predetermined included angle with center plane 51 of fixed magnet 5. At this time, as shown with the lines of magnetic force in FIG. 5, one part of fixed magnet 5 is shorted through the iron part of magnetic core 81, one part of turnable magnet 6 is shorted through the iron part of housing 2; their another parts have the same direction in magnetic fields, and these two magnetic fields are superimposed, generating trial clamping magnetic force to clamping surface 3 for trial clamping of object 4. The trial clamping magnetic force is higher than zero magnetic force and lower than maximum magnetic force. For trial clamping of object 4, it is better to have trial clamping magnetic force within 10% to 90% of maximum magnetic force, and it is the best to have trial clamping magnetic force be 50% of maximum magnetic force.

When turnable magnet 6 turns to the third position, center plane 61 of turnable is magnet 6 roughly aligns to center plane 51 of fixed magnet 5, and is roughly on the same plane. Turnable magnet 6 is so set that the direction of its width agrees with the left-right direction, and the direction of its height agrees with the up-down direction; and S pole on turnable magnet 6 and S pole on fixed magnet 5 are both on left side of fixed magnet 5, N pole on turnable magnet 6 and N pole on fixed magnet 5 are both on the right side of fixed magnet 5. At this time, magnetic field generated by fixed magnet 5 and magnetic field generated by turnable magnet 6 have the same direction, as shown with the lines of magnetic force in FIG. 6. These two magnetic fields are superimposed, the magnetic force generated to clamping surface 3 is the maximum magnetic force, thus clamping object 4.

The permanent magnetic lifting device 1 also has a handle 8, the handle 8 is for an operator to operate manually outside housing 2 to drive turnable magnet 6 to the first position, second position or third position. The handle 8 has: a magnetic core 81; inside a part of magnetic core 81 is set internally turnable magnet 6; this part is inserted into a hole 21 made internally in housing 2; another part of magnetic core 81 protrudes out of housing 2; on this another part a through hole 83 is made radially; a handle grip 82; one end of the handle grip 82 is for an operator to operate manually outside housing 2, another end is inserted into and through the through hole 83. An operator holds handle grip 82 to turn the handle, thus driving magnetic core 81 to turn, and finally turnable magnet 6 turns with magnetic core 81.

Positioning mechanism 7 for second position includes: a retaining pin 71, which is set in the part of housing 2, corresponding to the travel route of the handle, in the course of handle 8 driving turnable magnet 6 to turn from the first position to the third position; a spring 72, applying elastic thrust to retaining pin 71 so that retaining pin 71 protrudes out of housing 2 in normal state; and an actuator 73, exposed outside housing 2 for an operator to operate so that retaining pin 71 overcomes the elastic thrust of spring 72 and retracts into housing 2.

There is a slope 74 on the front end of retaining pin 71, in the course of handle 8 driving turnable magnet 6 to turn from the first position to the third position, when handle 8 moves to the position where retaining pin 71 is set, under the condition that actuator 73 is not operated, handle 8 touches slope 74 and pushes slope 74 so that retaining pin 71 overcomes the elastic thrust of spring 72 and retracts into housing 2, enabling handle 8 to pass the position where retaining pin 71 is set; in the course of handle 8 driving turnable magnet 6 to turn from the third position to the first position, when handle 8 moves to the position where retaining pin 71 is set, under the condition that actuator 73 is not operated, handle 8 touches plane 75, which is on the back of slope 74, on retaining pin 71 and is blocked by retaining pin 71, thus being positioned where retaining pin 71 is set.

In the part, corresponding to the travel route of the handle, of the front surface of housing 2, a deep hole 22 is made in front-rear direction, spring 72 is set in deep hole 22, rear end of spring 72 touches the bottom of deep hole 22. Rear end of retaining pin 71 touches front end of spring 72, the middle part of retaining pin 71 integrates with actuator 73, slope 74 is the inclined plane formed by means of cutting the front end of retaining pin 71 intersecting the axis of retaining pin 71, that is, slope 74 is a slope which inclines from right to left with inclination from rear to front.

There may not be a slope on the front end of retaining pin 71, in this structure, in the course of handle 8 driving turnable magnet 6 to turn from the first position to the third position, when handle 8 moves to the position where retaining pin 71 is set, under the condition that actuator 73 is not operated, handle 8 touches the front end of retaining pin 71, and cannot pass the position where retaining pin 71 is set; under the condition that actuator 73 is operated, retaining pin 71 overcomes the elastic thrust of spring 72 and retracts into housing 72, handle 8 can pass the position where retaining pin 71 is set; in the course of handle 8 driving turnable magnet 6 to turn from the third position to the first position, when handle 8 moves to the position where retaining pin 71 is set, under the condition that actuator 73 is not operated, handle 8 touches the front end of retaining pin 71 and is blocked by retaining pin 71, thus being positioned where retaining pin 71 is set.

Positioning mechanism 9 for first position and third position is installed on the front surface of housing 2 with screws, and is located just beneath magnetic core 81 of handle 8 and adjoining magnetic core 81. Of course, positioning mechanism 9 for first position and third position may also integrate with housing 2. The positioning mechanism 9 for first position and third position is roughly in the shape of a concave. When turnable magnet 6 is in the first position or third position, another end of handle grip 82 protrudes right above the step on either left side or right side of positioning mechanism 9 for first position and third position under the thrust of spring 91, turning of handle grip 82 is stopped by the steps on both left and right sides of positioning mechanism 9 for first position and third position, so that turnable magnet 6 is positioned in the first position and the third position. When an operator wants to turn handle 8, he/she must overcome the thrust of spring 91 and pull another end of handle grip 82 to force it away from above the step on either left side or right side to turn handle 8.

Below how an operator can make use of the permanent magnetic lifting device 1 in accordance with the present invention to hoist object 4 is described.

First, move permanent magnetic lifting device 1 above object 4 to be clamped so that clamping surface 3 contacts the top surface of object 4. At this time, handle 8 is in the "OFF" position on the right side, that is, turnable magnet 6 is in the first position, the magnetic fields of turnable magnet 6 and fixed magnet 5 are neutralized, therefore, the magnetic force generated to clamping surface 3 is zero magnetic force, no clamping of object 4 is done.

Then, the operator pulls another end of grip 82 to force it away from above the step on the left side of positioning mechanism 9 for first position and third position so that handle 8 turns counterclockwise.

When handle 8 turns to the position where retaining pin 71 is set, under the condition that actuator 73 is not operated, handle 8 touches slope 74 and pushes slope 74 so that retaining pin 71 overcomes the elastic thrust of spring 72 and retracts into housing 2, handle 8 is thus able to pass the position where retaining pin 71 is set.

At this time, the operator releases handle 8, turnable magnet 6, by the action of the magnetic field of fixed magnet 5, is driven by the force to turn clockwise, and handle 8 also turns clockwise. When handle 8 turns automatically to the position where retaining pin 71 is set, under the condition that actuator 73 is not operated, handle 8 touches plane 75, which is on the back of slope 74, of retaining pin 71 and is blocked by retaining pin 71, thus being positioned where retaining pin 71 is set, that is, turnable magnet 6 is positioned in the second position. At this time, a part of the magnetic fields of fixed magnet 5 and turnable magnet 6 are shorted with housing 2 through magnetic core 81 of permanent magnetic lifting device 1; their another parts have the same direction in magnetic fields, and these two magnetic fields are superimposed, generating trial clamping magnetic force to clamping surface 3 for trial clamping of object 4. The operator lifts permanent magnetic lifting device 1 to hoist on trial.

If permanent magnetic lifting device 1 is not able to hoist object 4, this means that the ratio of the maximum clamping force that can be generated by permanent magnetic lifting device 1 to hoist in the third position to the weight of workpiece is lower than the ratio set for the second position, so warning and alarm are given to the operator whether to hoist object 4 or not. At this time, the operator operates actuator 73 to retract retaining pin 71 into housing 2, and at the same time, to turn handle 8 clockwise to pass the position for retaining pin 71 and turn further to the "OFF" position.

If permanent magnetic lifting device 1 is able to hoist object 4, this means that the ratio of the maximum clamping force that can be generated by permanent magnetic lifting device 1 under this specific condition to the weight of workpiece equals or exceeds the ratio set for the second position. The operator can turn handle 8 further counterclockwise until handle 8 turns to the "ON" position on the left, that is, turnable magnet 6 turns to the third position. The operator releases handle 8, another end of handle grip 82 protrudes right above the step on the right side of positioning mechanism 9 for first position and third position under the thrust of spring 91, turning of handle grip 82 is stopped by the steps on both left and right sides of positioning mechanism 9 for first position and third position, so that turnable magnet 6 is positioned, that is, it is positioned in the third position. At this time, the magnetic fields of fixed magnet 5 and turnable magnet 6 are superimposed, the magnetic force generated to clamping surface 3 is the maximum magnetic force, thus clamping object 4. The operator carries out hoisting of object 4 in the third position.

When object 4 is hoisted and moved to a prescribed location, the operator unloads the workpiece and pulls the handle out so that handle 8, which is in the "ON" position, turns to the position for retaining pin 71, and operates actuator 73 to retract retaining pin 71 into housing 2, thus to enable handle 8 to pass the position for retaining pin 71 and turn further to the "OFF" position.

The second embodiment in accordance with the present invention is described below in detail with reference to FIGS. 8 to 11.

In the second embodiment, the same structures as in the first embodiment are marked with the same numbers, and descriptions are omitted.

The difference in structures between the second embodiment and the first embodiment is in the fixed magnet. Fixed magnets 251, 252 and turnable magnet 6 are all cuboids. A pair of fixed magnets 251 and 252 connect to insulator 253 on both sides of its width and integrate with it, and are fixed to the upper part inside housing 2. Insulator 253 is so set that the direction of its width agrees with the left-right direction, the direction of its length agrees with the front-rear direction, and the direction of its height agrees with the up-down direction. The planes formed on insulator 253 lengthwise and widthwise are parallel to the plane on which clamping surface 3 lies; S poles and N poles on fixed magnets 251 and 252 are on the side opposite the plane on which clamping surface 3 lies and the side on the back of this side respectively, and fixed magnets 251 and 252 have opposite polarities, that is, S pole on fixed magnet 251 and N pole on fixed magnet 252 are on the side opposite the plane on which clamping surface 3 lies, N pole on fixed magnet 251 and S pole on fixed magnet 252 are on the side on the back of this side. Turnable magnet 6 is set on the lower part inside housing 2, and is located in the center in left-right direction of permanent magnetic lifting device 1. Two sides on the width of turnable magnet 6 are S pole and N pole respectively. Turnable magnet 6 is able to turn around its own centerline 62 parallel to its lengthwise direction; centerline 62 is approximately on the plane on which lies center plane 254 which bisects insulator 253 along the height of insulator 253.

when turnable magnet 6 turns to the first position, center plane 61 of turnable magnet 6, which bisects turnable magnet 6 along its height, roughly aligns to center plane 254 of insulator 253 (if the magnetic energy of turnable magnet 6 is greater than the total magnetic energy of fixed magnets 251 and 252, a relatively small angle can be included between center plane 61 of turnable magnet 6 and center plane 254 of insulator 253, at this time, the magnetic energy in turnable magnet 6, after partial short-circuit, the remaining magnetic energy is neutralized with the magnetic energy in fixed magnets 251 and 252), and is roughly on the same plane. Turnable magnet 6 is so set that the direction of its width agrees with the left-right direction, and the direction of its height agrees with the up-down direction. Fixed magnet 251 is on the N pole side of turnable magnet 6, and the side on fixed magnet 251 near turnable magnet 6, namely the lower side, is S pole. Fixed magnet 252 is on the S pole side of turnable magnet 6, and the side on fixed magnet 252 near turnable magnet 6, namely the lower side, is N pole. Of course, polarities on turnable magnet 6 and fixed magnets 251 and 252 can be the opposite to above description. At this time, the direction of magnetic fields generated by fixed magnets 251 and 252 is exactly opposite the direction of magnetic field generated by turnable magnet 6, as shown with the lines of magnetic force in FIG. 9. The magnetic fields are neutralized, the magnetic force generated to clamping surface 3 is zero, and object 4 cannot be clamped.

When turnable magnet 6 turns to the second position, center plane 61 of turnable magnet 6 makes a predetermined included angle with center plane 254 of insulator 253. At this time, as shown with the lines of magnetic force in FIG. 10, a part of the magnetic fields of fixed magnets 251, 252 and turnable magnet 6 are shorted with housing through the magnetic core inside permanent magnetic lifting device 1, and another part of the magnetic fields have the same direction, and these magnetic fields are superimposed, generating trial clamping magnetic force to clamping surface 3 for trial clamping of object 4. The trial clamping magnetic force is higher than zero magnetic force and lower than maximum magnetic force. For trial clamping of object 4, it is better to have trial clamping magnetic force within 10% to 90% of maximum magnetic force, and it is the best to have trial clamping magnetic force be 50% of maximum magnetic force.

When turnable magnet 6 turns to the third position, center plane 61 of turnable magnet 6 roughly aligns to center plane 254 of insulator 253, and is roughly on the same plane. Turnable magnet 6 is so set that the direction of its width agrees with the left-right direction, and the direction of its height agrees with the up-down direction. Fixed magnet 251 is on the S pole side of turnable magnet 6, and the side on fixed magnet 251 near turnable magnet 6, namely the lower side, is S pole. Fixed magnet 252 is on the N pole side of turnable magnet 6, and the side on fixed magnet 252 near turnable magnet 6, namely the lower side, is N pole. At this time, the magnetic fields generated by fixed magnets 251 and 252 and the magnetic field generated by turnable magnet 6 have the same direction, as shown with the lines of magnetic force in FIG. 11. The magnetic fields are superimposed, the magnetic force generated to clamping surface 3 is the maximum magnetic force, thus clamping object 4.

The third embodiment in accordance with the present invention is described below in detail with reference to FIGS. 12 to 15.

In the third embodiment, the same structures as in the first embodiment are marked with the same numbers, and descriptions are omitted.

The difference in structures between the third embodiment and the first embodiment is in the structure of handle, positioning mechanism for second position, and positioning mechanism for first position and third position.

The positioning mechanism for second position is retaining pin 307. The retaining pin 307 is set fixedly in the part on housing 2, corresponding to the travel route of handle 8, in the course of handle 8 driving turnable magnet 6 to turn from the first position to the third position, protruding out of housing 2. Handle 8 includes: a stopper 383, which protrudes from the outer circumferential surface of handle 8 to the side of housing; a pressing piece 384, which connects stopper 383 with a rod-like part 386 and protrudes out of handle 8 for a certain distance for an operator to depress to move stopper 383; a spring 385, which applies elastic thrust to pressing piece 384 so that that pressing piece 384 keeps protruding out of handle 8 for a certain distance in normal state.

Inside grip 382 of handle 8 a deep hole 387 is made along its length. In deep hole 387, a portion, which is near magnetic core 81 (called internal portion hereinafter), and another portion, which is far away from magnetic core 81 (called external portion hereinafter), have larger internal diameters, while the middle portion of the hole has a smaller internal diameter. Stopper 383 is set in the position in deep hole 387, most close to the middle portion of the hole, and, through the rod-like part 386 inserted in the above-mentioned middle portion, connects pressing piece 384 set in the external portion of deep hole 387. A part of pressing piece 384 protrudes out of handle 8 for a certain distance. One end of spring 385 props the step between the middle portion and external portion of deep hole 387, and another end props pressing piece 384, to exert elastic thrust to pressing piece 384, so that pressing piece 384 keeps protruding out of handle 8 for a certain distance in normal state. And, on a part of the surface of grip 382, which is near housing 2, a groove is made along the length of grip 382. The groove is positioned corresponding to the position of internal portion of deep hole 387, and connects to the internal portion of deep hole 387. Stopper 383 protrudes from the bottom of the groove out of grip 382. When an operator depresses pressing piece 384, pressing piece 384 overcomes the elastic thrust of spring 384 and, by means of rod-like part 386, moves stopper 383 along the groove to magnetic core 81.

in the course of handle 8 driving turnable magnet 6 to turn from the first position to the third position or turn from the third position to the first position, when handle 8 moves to the position where retaining pin 307 is set, under the condition that pressing piece 384 is not depressed, stopper 383 on handle 8 touches retaining pin 307 so that handle 8 is blocked by retaining pin 307; under the condition that pressing piece 384 is depressed by an operator, stopper 383 moves to avoid touching retaining pin 307, so that handle 8 can pass the position where retaining pin 307 is set.

Positioning mechanism for first position and third position includes positioning pins 391, 392, and a retaining pin 393, among which, positioning pins 391 and 392 are set fixedly in the lower parts on the left and right sides respectively of the front surface of housing 2; retaining pin 393 is set fixedly in the middle on the left side of the front surface of housing 2.

When turnable magnet 6 is in the first position, under the condition that pressing piece 384 is not depressed, stopper 383 on handle 8 is located above positioning pin 392 and touches positioning pin 392, turnable magnet 6 is thus positioned in the first position. When turnable magnet 6 is in the third position, under the condition that pressing piece 384 is not depressed, stopper 383 on handle 6 is located above positioning pin 391 and below retaining pin 393, and touches positioning pin 391 and retaining pin 393, turnable magnet 6 is thus positioned in the third position.

Below how an operator can make use of the permanent magnetic lifting device 1 in accordance with the present invention to hoist object 4 is described.

First, move permanent magnetic lifting device 1 above object 4 to be clamped so that clamping surface 3 contacts the top surface of object 4. At this time, handle 8 is in the "OFF" position on the right side, that is, turnable magnet 6 is in the first position, the magnetic fields of turnable magnet 6 and fixed magnet 5 are neutralized, therefore, the magnetic force generated to clamping surface 3 is zero magnetic force, no clamping of object 4 is done.

Then, the operator turns handle 8 counterclockwise.

When handle 8 turns to the position where retaining pin 307 is set, the operator depresses pressing piece 384 to move stopper 383 towards magnetic core 81, so as to avoid stopper 383 touching retaining pin 307, enabling handle 8 to pass the position where retaining pin 307 is set.

At this time, the operator releases handle 8, turnable magnet 6, by the action of the magnetic field of fixed magnet 5, is driven by the force to turn clockwise, and handle 8 also turns clockwise. When handle 8 turns automatically to the position where retaining pin 307 is set, under the condition that pressing piece 384 is not depressed, handle 8 touches retaining pin 307 and is blocked by retaining pin 307, thus being positioned where retaining pin 307 is set, that is, turnable magnet 6 is positioned in the second position. At this time, a part of the magnetic fields of fixed magnet 5 and turnable magnet 6 are shorted with housing through magnetic core in permanent magnetic lifting device 1; their another parts have the same direction in magnetic fields, and these two magnetic fields are superimposed, generating trial clamping magnetic force to clamping surface 3 for trial clamping of object 4. The operator lifts permanent magnetic lifting device 1 to hoist on trial.

If permanent magnetic lifting device 1 is not able to hoist object 4, this means that the ratio of the maximum clamping force that can be generated by permanent magnetic lifting device 1 to hoist in the third position to the weight of workpiece is lower than the ratio set for the second position, so warning and alarm are given to the operator whether to hoist object 4 or not. At this time, the operator depresses pressing piece 384 to move stopper 383 towards magnetic core 81 to avoid touching retaining pin 307, and at the same time, to turn handle 8 clockwise to pass the position for retaining pin 307 and turn further to the "OFF" position.

If permanent magnetic lifting device 1 is able to hoist object 4, this means that the ratio of the maximum clamping force that can be generated under this specific condition to the weight of workpiece equals or exceeds the ratio set for the second position. The operator can turn handle 8 counterclockwise further. When it turns to the position where retaining pin 393 is set, the operator depresses pressing piece 384 to move stopper 383 towards magnetic core 81 to avoid touching retaining pin 393 so that handle 8 can pass the position where retaining pin 393 is set. At this time, handle 8 turns to the "ON" position on the left, that is, turnable magnet 6 turns to the third position. Stopper 383 on handle 6 is located above positioning pin 391 and below retaining pin 393. Under the condition that pressing piece 384 is not depressed, stopper 383 touches positioning pin 391 and retaining pin 393, handle 8 is thus positioned, that is, turnable magnet 6 is positioned in the third position. At this time, the magnetic fields of fixed magnet 5 and turnable magnet 6 are superimposed, the magnetic force generated to clamping surface 3 is the maximum magnetic force, thus clamping object 4. The operator carries out hoisting of object 4 in the third position.

When object 4 is hoisted and moved to a prescribed location, the operator unloads the workpiece and depresses pressing piece 384 to move stopper 383 towards magnetic core 81 to avoid contacting retaining pin 393, and at the same time, to turn handle 8 clockwise to pass the position for retaining pin 393 and turn to the position for retaining pin 307, and depresses pressing piece 384 again to move stopper 383 again towards magnetic core 81 to avoid contacting retaining pin 307, thus to enable handle 8 to pass the position for retaining pin 307 and turn further to the "OFF" position.

The fourth embodiment in accordance with the present invention is described below in detail with reference to FIGS. 16 to 19.

In the fourth embodiment, the same structures as in the third embodiment are marked with the same numbers, and descriptions are omitted.

The difference in structures between the fourth embodiment and the third embodiment is in fixed magnets. Fixed magnets 451, 452 and turnable magnet 6 are all cuboids. A pair of fixed magnets 451 and 452 connect to insulator 453 on both sides of its width and integrate with it, and are fixed to the upper part inside housing 2. Insulator 453 is so set that the direction of its width agrees with the left-right direction, the direction of its length agrees with the front-rear direction, and the direction of its height agrees with the up-down direction. The planes formed on insulator 453 lengthwise and widthwise are parallel to the plane on which clamping surface 3 lies; S poles and N poles on fixed magnets 451 and 452 are on the side opposite the plane on which clamping surface 3 lies and the side on the back of this side respectively, and fixed magnets 451 and 452 have opposite polarities, that is, S pole on fixed magnet 451 and N pole on fixed magnet 452 are on the side opposite the plane on which clamping surface 3 lies, N pole on fixed magnet 451 and S pole on fixed magnet 452 are on the side on the back of this side. Turnable magnet 6 is set on the lower part inside housing 2, and is located in the center in left-right direction of permanent magnetic lifting device 1. Two sides on the width of turnable magnet 6 are S pole and N pole respectively. Turnable magnet 6 is able to turn around its own centerline 62 parallel to its lengthwise direction; centerline 62 is approximately on the plane on which lies center plane 454 which bisects insulator 453 along the height of insulator 453.

when turnable magnet 6 turns to the first position, center plane 61 of turnable magnet 6, which bisects turnable magnet 6 along its height, roughly aligns to center plane 454 of insulator 453 (if the magnetic energy of turnable magnet 6 is greater than the total magnetic energy of fixed magnets 451 and 452, a relatively small angle can be included between center plane 61 of turnable magnet 6 and center plane 454 of insulator 453, at this time, the magnetic energy in turnable magnet 6, after partial short-circuit, the remaining magnetic energy is neutralized with the magnetic energy in fixed magnets 451 and 452), and is roughly on the same plane. Turnable magnet 6 is so set that the direction of its width agrees with the left-right direction, and the direction of its height agrees with the up-down direction. Fixed magnet 451 is on the N pole side of turnable magnet 6, and the side on fixed magnet 451 near turnable magnet 6, namely the lower side, is S pole. Fixed magnet 452 is on the S pole side of turnable magnet 6, and the side on fixed magnet 452 near turnable magnet 6, namely the lower side, is N pole. At this time, the direction of magnetic fields generated by fixed magnets 451 and 452 is exactly opposite the direction of magnetic field generated by turnable magnet 6, as shown with the lines of magnetic force in FIG. 17. The magnetic fields are neutralized, the magnetic force generated to clamping surface 3 is zero, and object 4 cannot be clamped.

When turnable magnet 6 turns to the second position, center plane 61 of turnable magnet 6 makes a predetermined included angle with center plane 454 of insulator 453. At this time, as shown with the lines of magnetic force in FIG. 18, a part of the magnetic fields of fixed magnets 451, 452 and turnable magnet 6 are shorted with housing through the magnetic core inside permanent magnetic lifting device 1, and another part of the magnetic fields have the same direction, and these magnetic fields are superimposed, generating trial clamping magnetic force to clamping surface 3 for trial clamping of object 4. The trial clamping magnetic force is higher than zero magnetic force and lower than maximum magnetic force. For trial clamping of object 4, it is better to have trial clamping magnetic force within 10% to 90% of maximum magnetic force, and it is the best to have trial clamping magnetic force be 50% of maximum magnetic force.

When turnable magnet 6 turns to the third position, center plane 61 of turnable magnet 6 roughly aligns to center plane 454 of insulator 453, and is roughly on the same plane. Turnable magnet 6 is so set that the direction of its width agrees with the left-right direction, and the direction of its height agrees with the up-down direction. Fixed magnet 451 is on the S pole side of turnable magnet 6, and the side on fixed magnet 451 near turnable magnet 6, namely the lower side, is S pole. Fixed magnet 452 is on the N pole side of turnable magnet 6, and the side on fixed magnet 452 near turnable magnet 6, namely the lower side, is N pole. At this time, the magnetic fields generated by fixed magnets 451 and 452 and the magnetic field generated by turnable magnet 6 have the same direction, as shown with the lines of magnetic force in FIG. 19. The magnetic fields are superimposed, the magnetic force generated to clamping surface 3 is the maximum magnetic force, thus clamping object 4.

The fifth embodiment in accordance with the present invention is described below in detail with reference to FIGS. 20 to 23.

In the fifth embodiment, the same structures as in the first embodiment are marked with the same numbers, and descriptions are omitted.

The difference in structures between the fifth embodiment and the first embodiment is in the structure of the positioning mechanism for first position and third position.

The positioning mechanism for first position and third position includes a retaining mechanism 570 and positioning pins 591 and 592.

Retaining mechanism 570 has the same structure as positioning mechanism 7 for second position. It includes: a retaining pin 571, set in the part of housing 2, corresponding to the travel route of the handle, in the course of handle 8 driving turnable magnet 6 to turn from the second position to the third position, i.e. set in the center of the left side of the front surface of housing 2; a spring, applying elastic thrust to retaining pin 571 so that retaining pin 571 protrudes out of housing 2 in normal state; and an actuator 573, exposed outside housing 2 for an operator to operate so that retaining pin 571 overcomes the elastic thrust of spring and retracts into housing 2.

There is a slope 574 on the front end of retaining pin 571, in the course of handle 8 driving turnable magnet 6 to turn from the second position to the third position, when handle 8 moves to the position where retaining pin 571 is set, under the condition that actuator 573 is not operated, handle 8 touches slope 574 and pushes slope 574 so that retaining pin 571 overcomes the elastic thrust of the spring and retracts into housing 2, enabling handle 8 to pass the position where retaining pin 571 is set; in the course of handle 8 driving turnable magnet 6 to turn from the third position to the second position, when handle 8 moves to the position where retaining pin 571 is set, under the condition that actuator 573 is not operated, handle 8 touches plane 575, which is on the back of slope 574, on retaining pin 571 and is blocked by retaining pin 571, thus being positioned where retaining pin 571 is set.

In the part of the front surface of housing 2, corresponding to the travel route of the handle, a deep hole 22 is made in front-rear direction, a spring is set in deep hole 22, rear end of the spring touches the bottom of deep hole 22. Rear end of retaining pin 571 touches front end of the spring, the middle part of retaining pin 571 integrates with actuator 573, slope 574 is the inclined plane formed by means of cutting the front end of retaining pin 571 intersecting the axis of retaining pin 571, that is, slope 574 is a slope which inclines from top to bottom with inclination from rear to front.

Positioning pins 591 and 592 are set fixedly on the lower parts of the left and right sides respectively of the front surface of housing 2. When turnable magnet 6 is in the first position, grip 82 on handle 8 is located above positioning pin 592 and touches positioning pin 592, turnable magnet 6 is thus positioned in the first position. When turnable magnet 6 is in the third position, grip 82 is located above positioning pin 591 and below retaining pin 571, and touches positioning pin 591 and retaining pin 571, turnable magnet 6 is thus positioned in the third position.

Below how an operator can make use of the permanent magnetic lifting device 1 in accordance with the present invention to hoist object 4 is described.

First, move permanent magnetic lifting device 1 above object 4 to be clamped so that clamping surface 3 contacts the top surface of object 4. At this time, handle 8 is in the "OFF" position on the right side, that is, turnable magnet 6 is in the first position, the magnetic fields of turnable magnet 6 and fixed magnet 5 are neutralized, therefore, the magnetic force generated to clamping surface 3 is zero magnetic force, no clamping of object 4 is done.

Then, the operator turns handle 8 counterclockwise.

When handle 8 turns to the position where retaining pin 71 is set, under the condition that actuator 73 is not operated, handle 8 touches slope 74 and pushes slope 74 so that retaining pin 71 overcomes the elastic thrust of spring 72 and retracts into housing 2, handle 8 is thus able to pass the position where retaining pin 71 is set. At this time, the operator releases handle 8, turnable magnet 6, by the action of the magnetic field of fixed magnet 5, is driven by the force to turn clockwise, and handle 8 also turns clockwise. When handle 8 turns automatically to the position where retaining pin 71 is set, under the condition that actuator 73 is not operated, handle 8 touches plane 75, which is on the back of slope 74, of retaining pin 71 and is blocked by retaining pin 71, thus being positioned where retaining pin 71 is set, that is, turnable magnet 6 is positioned in the second position. At this time, a part of the magnetic fields of fixed magnet 5 and turnable magnet 6 are shorted with housing through magnetic core of permanent magnetic lifting device 1; their another parts have the same direction in magnetic fields, and these two magnetic fields are superimposed, generating trial clamping magnetic force to clamping surface 3 for trial clamping of object 4. The operator lifts permanent magnetic lifting device 1 to hoist on trial.

If permanent magnetic lifting device 1 is not able to hoist object 4, this means that the ratio of the maximum clamping force that can be generated by permanent magnetic lifting device 1 to hoist in the third position to the weight of workpiece is lower than the ratio set for the second position, so warning and alarm are given to the operator whether to hoist object 4 or not. At this time, the operator operates actuator 73 to retract retaining pin 71 into housing 2, and at the same time, to turn handle 8 clockwise to pass the position for retaining pin 71 and turn further to the "OFF" position.

If permanent magnetic lifting device 1 is able to hoist object 4, this means that the ratio of the maximum clamping force that can be generated by permanent magnetic lifting device 1 under this specific condition to the weight of workpiece equals or exceeds the ratio set for the second position. The operator can turn handle 8 further counterclockwise. When handle 8 turns to the position where retaining pin 571 is set, under the condition that actuator 573 is not operated, handle 8 touches slope 574 and pushes slope 574 so that retaining pin 571 overcomes the elastic thrust of the spring and retracts into housing 2, enabling handle 8 to pass the position where retaining pin 571 is set. At this time, handle 8 turns to the "ON" position on the left, that is, turnable magnet 6 turns to the third position. Grip 82 on handle 8 is located above positioning pin 591 and below retaining pin 571. Handle 8 touches positioning pin 591, and under the condition that actuator is not operated, handle 8 also touches plane 575, which is on the back of slope 574, on retaining pin 571, handle 8 is thus positioned, that is, turnable magnet 6 is positioned in the third position. At this time, the magnetic fields of fixed magnet 5 and turnable magnet 6 are superimposed, the magnetic force generated to clamping surface 3 is the maximum magnetic force, thus clamping object 4. The operator carries out hoisting of object 4 in the third position.

When object 4 is hoisted and moved to a prescribed location, the operator, after unloading the workpiece, first operates actuator 573 to retract retaining pin 571 into housing 2, and at the same time, to turn handle 8 clockwise to pass the position where retaining pin 571 is set, and turn to the position for retaining pin 71, then operates actuator 73 to retract retaining pin 71 into housing 2, thus to enable handle 8 to pass the position for retaining pin 71 and turn further to the "OFF" position.

The sixth embodiment in accordance with the present invention is described below in detail with reference to FIGS. 24 to 27.

In the sixth embodiment, the same structures as in the fifth embodiment are marked with the same numbers, and descriptions are omitted.

The difference in structures between the sixth embodiment and the fifth embodiment is in the fixed magnet. Fixed magnets 651, 652 and turnable magnet 6 are all cuboids. A pair of fixed magnets 651 and 652 connect to insulator 653 on both sides of its width and integrate with it, and are fixed to the upper part inside housing 2. Insulator 653 is so set that the direction of its width agrees with the left-right direction, the direction of its length agrees with the front-rear direction, and the direction of its height agrees with the up-down direction. The planes formed on insulator 653 lengthwise and widthwise are parallel to the plane on which clamping surface 3 lies; S poles and N poles on fixed magnets 651 and 652 are on the side opposite the plane on which clamping surface 3 lies and the side on the back of this side respectively, and fixed magnets 651 and 652 have opposite polarities, that is, S pole on fixed magnet 651 and N pole on fixed magnet 652 are on the side opposite the plane on which clamping surface 3 lies, N pole on fixed magnet 651 and S pole on fixed magnet 652 are on the side on the back of this side. Turnable magnet 6 is set on the lower part inside housing 2, and is located in the center in left-right direction of permanent magnetic lifting device 1. Two sides on the width of turnable magnet 6 are S pole and N pole respectively. Turnable magnet 6 is able to turn around its own centerline 62 parallel to its lengthwise direction; centerline 62 is approximately on the plane on which lies center plane 654 which bisects insulator 653 along the height of insulator 653.

When turnable magnet 6 turns to the first position, center plane 61 of turnable magnet 6, which bisects turnable magnet 6 along its height, roughly aligns to center plane 654 of insulator 653 (if the magnetic energy of turnable magnet 6 is greater than the total magnetic energy of fixed magnets 651 and 652, a relatively small angle can be included between center plane 61 of turnable magnet 6 and center plane 654 of insulator 653, at this time, the magnetic energy in turnable magnet 6, after partial short-circuit, the remaining magnetic energy is neutralized with the magnetic energy in fixed magnets 651 and 652), and is roughly on the same plane. Turnable magnet 6 is so set that the direction of its width agrees with the left-right direction, and the direction of its height agrees with the up-down direction. Fixed magnet 651 is on the N pole side of turnable magnet 6, and the side on fixed magnet 651 near turnable magnet 6, namely the lower side, is S pole. Fixed magnet 652 is on the S pole side of said turnable magnet 6, and the side on fixed magnet 652 near turnable magnet 6, namely the lower side, is N pole. At this time, the direction of magnetic fields generated by fixed magnets 651 and 652 is exactly opposite the direction of magnetic field generated by turnable magnet 6, as shown with the lines of magnetic force in FIG. 25. The magnetic fields are neutralized, the magnetic force generated to clamping surface 3 is zero, and object 4 cannot be clamped.

When turnable magnet 6 turns to the second position, center plane 61 of turnable magnet 6 makes a predetermined included angle with center plane 654 of insulator 653. At this time, as shown with the lines of magnetic force in FIG. 26, a part of the magnetic fields of fixed magnets 651, 652 and turnable magnet 6 are shorted with housing through the magnetic core inside permanent magnetic lifting device 1, and another part of the magnetic fields have the same direction, and these magnetic fields are superimposed, generating trial clamping magnetic force to clamping surface 3 for trial clamping of object 4. The trial clamping magnetic force is higher than zero magnetic force and lower than maximum magnetic force. For trial clamping of object 4, it is better to have trial clamping magnetic force within 10% to 90% of maximum magnetic force, and it is the best to have trial clamping magnetic force be 50% of maximum magnetic force.

When turnable magnet 6 turns to the third position, center plane 61 of turnable magnet 6 roughly aligns to center plane 654 of insulator 653, and is roughly on the same plane. Turnable magnet 6 is so set that the direction of its width agrees with left-right direction, and the direction of its height agrees with up-down direction. Fixed magnet 651 is on the S pole side of turnable magnet 6, and the side on fixed magnet 651 near turnable magnet 6, namely the lower side, is S pole. Fixed magnet 652 is on the N pole side of turnable magnet 6, and the side on fixed magnet 652 near turnable magnet 6, namely the lower side, is N pole. At this time, the magnetic fields generated by fixed magnets 651 and 652 and the magnetic field generated by turnable magnet 6 have the same direction, as shown with the lines of magnetic force in FIG. 27. The magnetic fields are superimposed, the magnetic force generated to clamping surface 3 is the maximum magnetic force, thus clamping object 4.

In the above-described permanent magnetic lifting device 1, turnable magnet is positioned in the second position by means of the positioning mechanism for second position, so that trial clamping magnetic force is higher than zero magnetic force and lower than maximum magnetic force, thus enabling an operator to easily operate trial clamping, and through operation of trial clamping, potential risk in safety which may occur in hoisting in the third position can also be thoroughly eliminated.

The embodiments in accordance with the present invention are described above, however, this invention is not limited to the described embodiments. As for the specific structures, appropriate changes can be made to the characteristics of the embodiments and different combinations can be done with the characteristics of the embodiments as long as they do not deviate from the scope of the purpose of this invention.

In the above-described embodiments, fixed magnet is positioned above turnable magnet. But this invention is not limited to this arrangement. Fixed magnet can also be positioned below turnable magnet.

Figure 28:
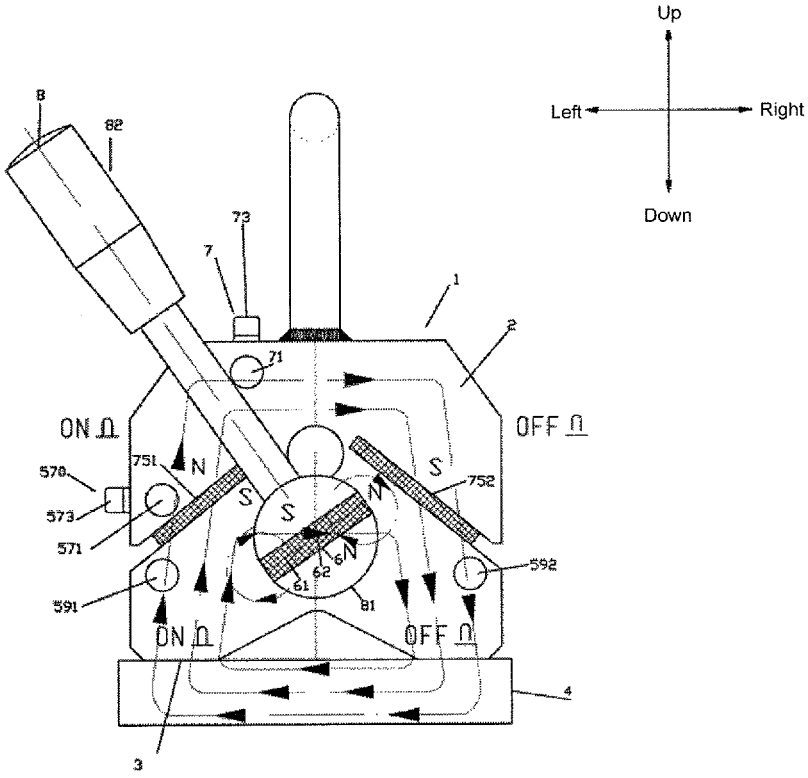
FIG. 28 is a schematic diagram of the lines of magnetic force inside the permanent magnetic lifting device of an embodiment variant and the workpiece when the permanent magnetic lifting device is in the second position.

In the above-described embodiments, fixed magnet is fixed in housing vertically or horizontally. But this invention is not limited to this arrangement. As shown in FIG. 28, fixed magnets 751 and 752 may also be fixed in housing aslant in a splay way. To be specific, fixed magnets 751, 752 and turnable magnet 6 are all cuboids; a pair of fixed magnets 751 and 752 slant in a splay way symmetrically about the center plane perpendicular to clamping surface 3; the left and right sides opposite each other on a pair of fixed magnets 751 and 752 are S pole and N pole respectively, and the left and right sides away from each other are N pole and S pole respectively; two sides on the width of turnable magnet 6 are S pole and N pole respectively; turnable magnet 6 is able to turn around its own centerline 62 parallel to its lengthwise direction. When turnable magnet 6 turns to said first position, center plane 61 of turnable magnet 6, which bisects turnable magnet 6 along its height, roughly aligns to the center plane perpendicular to clamping surface 3, and is roughly on the same plane; the left side in two opposite sides of a pair of fixed magnets 751 and 752 is S pole, one side of turnable magnet 6 opposite the left side is N pole; the right side in two opposite sides of a pair of fixed magnets 751 and 752 is N pole, another side of turnable magnet 6 is S pole (Of course, polarities on turnable magnet 6 and fixed magnets 751 and 752 can be the opposite to above description). When turnable magnet 6 turns to the second position, center plane 61 of turnable magnet 6, which bisects turnable magnet 6 along its height, makes a predetermined included angle with the center plane perpendicular to clamping surface 3. When turnable magnet 6 turns to the third position, the left side in two opposite sides of a pair of fixed magnets 751 and 752 is S pole, one side of turnable magnet 6 opposite this side is S pole, the right side in two opposite sides of a pair of fixed magnets 751 and 752 is N pole, another side of turnable magnet 6 is N pole.

The invention claimed is:

1. A permanent magnetic lifting device, comprising:

a housing, at the bottom of which is a clamping surface for clamping objects;

at least a fixed magnet, set in said housing relatively fixed to the housing; and a turnable magnet, set in said housing relatively turnable to said fixed magnet, wherein when said turnable magnet is in a first position relative to said fixed magnet, the magnetic force generated by said fixed magnet and said turnable magnet to said clamping surface is zero magnetic force; when said turnable magnet is in a third position relative to said fixed magnet, the magnetic force generated by said fixed magnet and said turnable magnet to said clamping surface is the maximum magnetic force;

the permanent magnetic lifting device further comprising a positioning mechanism for second position, wherein when the positioning mechanism for second position positions said turnable magnet in the second position relative to said fixed magnet, said fixed magnet and said turnable magnet generate trial clamping magnetic force to said clamping surface for clamping objects, the trial clamping magnetic force being higher than zero magnetic force and lower than maximum magnetic force.

2. A permanent magnetic lifting device as claimed in claim 1, which is characterized by: said fixed magnet and said turnable magnet are both cuboids, said fixed magnet along its height is perpendicular to the plane on which said clamping surface lies, two sides of the width of said fixed magnet are S pole and N pole respectively, two sides on the width of said turnable magnet are S pole and N pole respectively, said turnable magnet is able to turn around its own centerline parallel to its lengthwise direction;

when said turnable magnet turns to said first position, N pole on said turnable magnet and S pole on said fixed magnet are on one side of the width of said fixed magnet, S pole on said turnable magnet and N pole on said fixed magnet are on another side of the width of said fixed magnet;

when said turnable magnet turns to said second position, the center plane of said turnable magnet, which bisects the turnable magnet along its height, makes a predetermined included angle with the center plane of said fixed magnet, which bisects the fixed magnet along its height;

when said turnable magnet turns to said third position, S pole on said turnable magnet and S pole on said fixed magnet are on one side of the width of said fixed magnet, N pole on said turnable magnet and N pole on said fixed magnet are on another side of the width of said fixed magnet.

3. A permanent magnetic lifting device as claimed in claim 1, which is characterized by: said fixed magnet and said turnable magnet are all cuboids, wherein a pair of said fixed magnets connect to an insulator on both sides of its width and integrate with it, and the planes formed on the insulator lengthwise and widthwise are parallel to the plane on which said clamping surfaces lies; S poles and N poles on said fixed magnets are on the side opposite the plane on which said clamping surface lies and the side on the back of the side opposite the plane on which said clamping surface lies respectively, and a pair of fixed magnets have opposite polarities; two sides on the width of said turnable magnet are S pole and N pole respectively; said turnable magnet is able to turn around its own centerline parallel to its lengthwise direction;

when said turnable magnet turns to said first position, one of the pair of fixed magnets is on the N pole side of said turnable magnet, and one side of that fixed magnet, which is near said turnable magnet, is S pole; another one of the pair of fixed magnets is on the S pole side of said turnable magnet, and one side of that fixed magnet, which is near said turnable magnet, is N pole;

when said turnable magnet turns to said second position, the center plane of said turnable magnet, which bisects the turnable magnet along its height, makes a predetermined included angle with the center plane of the insulator, which bisects the insulator along its height;

when said turnable magnet turns to said third position, one of the pair of fixed magnets is on the S pole side of said turnable magnet, and the side of that fixed magnet, which is near said turnable magnet, is S pole; another one of the pair of fixed magnets is on the N pole side of said turnable magnet, and the side of that fixed magnet, which is near said turnable magnet, is N pole.

4. A permanent magnet lifting device as claimed in claim 1, which is characterized by: said fixed magnet and said turnable magnet are all cuboids, wherein a pair of said fixed magnets slant in a splay way symmetrically about the center plane perpendicular to said clamping surface; the sides opposite each other on a pair of said fixed magnets are S pole and N pole respectively, and the sides away from each other are N pole and S pole respectively; two sides on the width of said turnable magnet are S pole and N pole respectively; said turnable magnet is able to turn around its own centerline parallel to its lengthwise direction;

when said turnable magnet turns to said first position, one of the two opposite sides of a pair of said fixed magnets is S pole, one side of said turnable magnet opposite this side is N pole, another one of the two opposite sides of a pair of said fixed magnets is N pole, another side of said turnable magnet is S pole;

when said turnable magnet turns to said second position, the center plane of said turnable magnet, which bisects the turnable magnet along its height, makes a predetermined included angle with the center plane perpendicular to said clamping surface;

when said turnable magnet turns to said third position, one of the two opposite sides of a pair of said fixed magnets is S pole, one side of said turnable magnet opposite this side is S pole, another one of the two opposite sides of a pair of said fixed magnets is N pole, another side of said turnable magnet is N pole.

5. A permanent magnetic lifting device as claimed in claim 1, which is characterized by: the permanent magnetic lifting device also has a handle, this handle is for an operator to operate manually outside said housing to drive said turnable magnet to said first position, said second position or said third position.

6. A permanent magnetic lifting device as claimed in claim 5, which is characterized by: said positioning mechanism for second position includes a first retaining pin, located in the part of said housing, corresponding to the travel route of said handle, in the course of said handle driving said turnable magnet to turn from said first position to said third position; a first spring, applying elastic thrust to the first retaining pin so that the first retaining pin protrudes out of the housing in normal state; and an actuator, exposed outside said housing for an operator to operate so that said first retaining pin overcomes the elastic thrust of said first spring and retracts into said housing.

7. A permanent magnetic lifting device as claimed in claim 6, which is characterized by: there is a slope on the front end of said first retaining pin, in the course of said handle driving turnable magnet to turn from said first position to said third position, when said handle moves to the position where said first retaining pin is set, under the condition that said actuator is not operated, said handle touches said slope and pushes that slope, so that said first retaining pin overcomes the elastic thrust of said first spring and retracts into said housing, enabling said handle to pass the position where said first retaining pin is set; in the course of said handle driving turnable magnet to turn from said third position to said first position, when said handle moves to the position where said first retaining pin is set, under the condition that said actuator is not operated, said handle touches the plane, which is on the back of said slope, of said first retaining pin and is blocked by that first retaining pin, thus being positioned where said first retaining pin is set.

8. A permanent magnetic lifting device as claimed in claim 7, which is characterized by: the rear end of said first retaining pin touches said first spring, the middle part of said first retaining pin integrates with said actuator, said slope is the inclined plane formed by means of cutting the front end of first retaining pin intersecting the axis of said first retaining pin.

9. A permanent magnetic lifting device as claimed in claim 6, which is characterized by: there is no slope on the front end of said first retaining pin, in the course of said handle driving turnable magnet to turn from said first position to said third position, when said handle moves to the position where said first retaining pin is set, under the condition that said actuator is not operated, said handle touches the front end of said first retaining pin, and cannot pass the position where said first retaining pin is set; under the condition that said actuator is operated, said first retaining pin overcomes the elastic thrust of said first spring and retracts into said housing, said handle can pass the position where said first retaining pin is set; in the course of said handle driving turnable magnet to turn from said third position to said first position, when said handle moves to the position where said first retaining pin is set, under the condition that said actuator is not operated, said handle touches the front end of said first retaining pin and is blocked by that first retaining pin, thus being positioned where said first retaining pin is set.

10. A permanent magnetic lifting device as claimed in claim 5, which is characterized by: said positioning mechanism for second position includes a second retaining pin; that second retaining pin is set fixedly in the part of said housing, corresponding to the travel route of said handle, in the course of said handle driving said turnable magnet to turn from said first position to said third position, protruding outside said housing; said handle includes: a stopper, which protrudes from the outer circumferential surface of said handle to the side of housing; a pressing piece, which connects said stopper with a rod-like part and protrudes out of said handle for a certain distance for an operator to depress to move the stopper; a second spring, which applies elastic thrust to that pressing piece so that that pressing piece keeps protruding out of said handle for a certain distance in normal state.

11. A permanent magnetic lifting device as claimed in claim 10, which is characterized by: in the course of said handle driving said turnable magnet to turn from said first position to said third position or turn from said third position to said first position, when said handle moves to the position where said second retaining pin is set, under the condition that said pressing piece is not depressed, said stopper on said handle touches said second retaining pin so that said handle is blocked by said second retaining pin; under the condition that said pressing piece is depressed by an operator, said stopper moves to avoid touching said second retaining pin, enabling said handle to pass the position where said second retaining pin is set.

12. A permanent magnetic lifting device as claimed in claim 1, which is characterized by: said trial clamping magnetic force is within 10% to 90% of said maximum magnetic force.

13. A permanent magnetic lifting device as claimed in claim 1, which is characterized by: said trial clamping magnetic force is 50% of said maximum magnetic force.

* * * * *